US011255193B2

(12) United States Patent
Mathers

(10) Patent No.: US 11,255,193 B2
(45) Date of Patent: Feb. 22, 2022

(54) HYDRAULIC MACHINE WITH STEPPED ROLLER VANE AND FLUID POWER SYSTEM INCLUDING HYDRAULIC MACHINE WITH STARTER MOTOR CAPABILITY

(71) Applicant: Mathers Hydraulics Technologies Pty Ltd, Bridgeman Downs (AU)

(72) Inventor: Norman Ian Mathers, Brisbane (AU)

(73) Assignee: Mathers Hydraulics Technologies Pty Ltd, Bridgeman Downs (AU)

( * ) Notice: Subject to any disclaimer, the term of this patent is extended or adjusted under 35 U.S.C. 154(b) by 49 days.

(21) Appl. No.: 16/491,112

(22) PCT Filed: Feb. 28, 2018

(86) PCT No.: PCT/AU2018/050180

§ 371 (c)(1),
(2) Date: Sep. 4, 2019

(87) PCT Pub. No.: WO2018/161108

PCT Pub. Date: Sep. 13, 2018

(65) Prior Publication Data

US 2020/0011180 A1 Jan. 9, 2020

Related U.S. Application Data

(60) Provisional application No. 62/504,283, filed on May 10, 2017, provisional application No. 62/467,658, filed on Mar. 6, 2017.

(51) Int. Cl.
*F03C 2/00* (2006.01)
*F03C 4/00* (2006.01)
(Continued)

(52) U.S. Cl.
CPC ..... *F01C 21/0863* (2013.01); *F01C 21/0809* (2013.01); *F01C 21/0836* (2013.01);
(Continued)

(58) Field of Classification Search
CPC ..... F01C 21/0809; F01C 21/0836; F01C 21/0863; F01C 21/0881; F04C 2/3447;
(Continued)

(56) References Cited

U.S. PATENT DOCUMENTS 983,754 A 2/1911 Nichols
2,003,615 A 6/1935 Charles et al.
(Continued)

FOREIGN PATENT DOCUMENTS

AU 2010320606 B2 2/2017
AU 2017202300 B2 10/2018
(Continued)

OTHER PUBLICATIONS

"U.S. Appl. No. 11/914,203, Notice of Allowance dated Feb. 1, 2011", 12 pgs.
(Continued)

*Primary Examiner* — Theresa Trieu
(74) *Attorney, Agent, or Firm* — Schwegman Lundberg & Woessner, P.A.

(57) ABSTRACT

Hydraulic devices are shown and described that can include a rotor, vanes and a ring. The rotor can be disposed for rotation about an axis. The plurality of vanes can each include a vane step. Each of the plurality of vanes can be moveable relative to the rotor between a retracted position and an extended position where the plurality of vanes work a hydraulic fluid introduced adjacent the rotor. A roller can be mounted to a tip of each of the plurality of vanes. The ring can be disposed at least partially around the rotor. The rotor can include one or more passages for ingress or egress of a
(Continued)

hydraulic fluid to or from a region adjacent the vane step and defined by at least the rotor and the vane step.

15 Claims, 22 Drawing Sheets

(51) Int. Cl.

| | |
|---|---|
| ***F04C 18/00*** | (2006.01) |
| ***F04C 2/00*** | (2006.01) |
| ***F01C 21/08*** | (2006.01) |
| *F04C 2/344* | (2006.01) |
| *F04C 14/06* | (2006.01) |
| *F04C 15/06* | (2006.01) |

(52) U.S. Cl.
CPC ..... *F01C 21/0881* (2013.01); *F04C 2/3447* (2013.01); *F04C 14/06* (2013.01); *F04C 15/06* (2013.01); *F04C 2240/56* (2013.01)

(58) Field of Classification Search
CPC ..... F04C 14/06; F04C 15/0088; F04C 15/06; F04C 2240/56
See application file for complete search history.

(56) References Cited

U.S. PATENT DOCUMENTS

| | | | |
|---|---|---|---|
| 2,570,411 | A | 10/1951 | Vickers |
| 2,612,110 | A | 9/1952 | Delegard |
| 2,696,790 | A | 12/1954 | Crow |
| 2,919,651 | A | 1/1960 | Gardiner |
| 2,962,972 | A | 12/1960 | Meter |
| 2,962,973 | A | 12/1960 | Bruce |
| 2,967,488 | A | 1/1961 | Gardiner |
| 2,982,223 | A | 5/1961 | Rosaen et al. |
| 2,985,467 | A | 5/1961 | Cable, Jr. et al. |
| 3,035,554 | A | 5/1962 | Selzler |
| 3,042,163 | A | 7/1962 | Lapsley |
| 3,102,494 | A | 9/1963 | Adams et al. |
| 3,120,154 | A | 2/1964 | Gilreath |
| 3,149,845 | A | 9/1964 | Knox |
| 3,160,147 | A | 12/1964 | Hanson et al. |
| 3,208,570 | A | 9/1965 | Aschauer |
| 3,223,044 | A | 12/1965 | Adams et al. |
| 3,254,606 | A | 6/1966 | Rosaen |
| 3,320,897 | A | 5/1967 | Eickmann |
| 3,362,340 | A | 1/1968 | Adams |
| 3,401,641 | A | 9/1968 | Adams et al. |
| 3,407,742 | A | 10/1968 | Mitchell et al. |
| 3,421,413 | A | 1/1969 | Adams et al. |
| 3,451,346 | A | 6/1969 | Pettibone et al. |
| 3,525,219 | A | 8/1970 | Minchokovich |
| 3,533,493 | A | 10/1970 | Braun |
| 3,578,888 | A | 5/1971 | Adams |
| 3,586,466 | A | 6/1971 | Erickson |
| 3,597,998 | A | 8/1971 | Ebert |
| 3,640,651 | A | 2/1972 | Johnson |
| 3,790,314 | A | 2/1974 | Swain et al. |
| 3,792,585 | A | 2/1974 | Eisenmann et al. |
| 3,895,565 | A | 7/1975 | Schottler |
| 3,929,356 | A | 12/1975 | Devincent et al. |
| 3,944,263 | A | 3/1976 | Arnold |
| 4,037,409 | A | 7/1977 | Leibach |
| 4,132,512 | A | 1/1979 | Roberts |
| 4,248,309 | A | 2/1981 | Hofle et al. |
| 4,260,343 | A | 4/1981 | Watanabe et al. |
| 4,272,227 | A | 6/1981 | Woodruff et al. |
| 4,274,010 | A | 6/1981 | Lawson-Tancred |
| 4,350,220 | A | 9/1982 | Carman |
| 4,354,809 | A | 10/1982 | Sundberg et al. |
| D269,454 | S | 6/1983 | Houseman |
| 4,406,599 | A | 9/1983 | Stephan |
| 4,412,789 | A | 11/1983 | Ohe et al. |
| 4,431,389 | A | 2/1984 | Johnson |
| 4,441,573 | A | 4/1984 | Carman et al. |
| 4,471,119 | A | 9/1984 | Wright |
| 4,472,119 | A | 9/1984 | Roberts |
| 4,505,654 | A | 3/1985 | Dean, Jr. et al. |
| 4,516,919 | A | 5/1985 | Roberts |
| 4,629,406 | A | 12/1986 | Tantardini |
| 4,646,521 | A | 3/1987 | Snyder |
| 4,659,297 | A | 4/1987 | Kahrs |
| 4,674,280 | A | 6/1987 | Stuhr |
| 4,861,235 | A | 8/1989 | Nakajima et al. |
| 4,913,636 | A | 4/1990 | Niemiec et al. |
| 4,963,080 | A | 10/1990 | Hansen |
| 5,029,461 | A | 7/1991 | Lawrence et al. |
| 5,064,362 | A | 11/1991 | Hansen et al. |
| 5,170,636 | A | 12/1992 | Hitosugi |
| 5,199,750 | A | 4/1993 | Yang |
| 5,385,458 | A | 1/1995 | Chu |
| D363,771 | S | 10/1995 | Mathers |
| 5,509,793 | A | 4/1996 | Cherry |
| 5,551,484 | A | 9/1996 | Charboneau |
| D380,039 | S | 6/1997 | Paleczny et al. |
| 5,655,369 | A | 8/1997 | Folsom et al. |
| 5,657,629 | A | 8/1997 | Folsom et al. |
| 5,733,109 | A | 3/1998 | Sundberg et al. |
| 5,904,043 | A | 5/1999 | Nagatomo |
| 6,015,278 | A | 1/2000 | Key et al. |
| 6,056,329 | A | 5/2000 | Kitani et al. |
| 6,135,742 | A | 10/2000 | Cho et al. |
| 6,634,865 | B2 | 10/2003 | Dalton |
| 6,817,438 | B2 | 11/2004 | Modrzejewski et al. |
| 7,070,399 | B2 | 7/2006 | Konishi et al. |
| 7,083,394 | B2 | 8/2006 | Dalton |
| 7,094,044 | B2 | 8/2006 | Strueh |
| 7,686,602 | B1 | 3/2010 | Landhuis |
| 7,914,411 | B2 | 3/2011 | Basteck |
| 7,955,062 | B2 | 6/2011 | Mathers |
| 8,535,030 | B2 | 9/2013 | Chua et al. |
| 8,584,452 | B2 | 11/2013 | Lloyd et al. |
| 8,597,002 | B2 | 12/2013 | Mathers |
| 8,691,063 | B2 | 4/2014 | Aleksandrov |
| 8,708,679 | B2 | 4/2014 | Mathers |
| 9,400,043 | B2 | 7/2016 | Mathers et al. |
| 9,638,188 | B2 | 5/2017 | Mathers |
| 9,874,270 | B2 | 1/2018 | Mathers |
| 10,428,798 | B2 | 10/2019 | Mathers |
| 10,487,657 | B2 | 11/2019 | Mathers et al. |
| 10,670,125 | B2 | 6/2020 | Mathers |
| 10,774,966 | B2 | 9/2020 | Mathers |
| 10,788,112 | B2 | 9/2020 | Mathers et al. |
| 11,085,299 | B2 | 8/2021 | Mathers |
| 2004/0047741 | A1 | 3/2004 | William |
| 2004/0136853 | A1 | 7/2004 | Clements et al. |
| 2004/0219046 | A1 | 11/2004 | Johnson et al. |
| 2006/0133946 | A1 | 6/2006 | Mathers |
| 2008/0310988 | A1 | 12/2008 | Mathers |
| 2009/0280021 | A1 | 11/2009 | Mathers |
| 2010/0024444 | A1 | 2/2010 | Sharma et al. |
| 2010/0028181 | A1 | 2/2010 | Mathers |
| 2010/0028641 | A1 | 2/2010 | Zhu et al. |
| 2010/0154402 | A1 | 6/2010 | Cho |
| 2010/0244447 | A1 | 9/2010 | Gopalswamy et al. |
| 2011/0056195 | A1 | 3/2011 | Lloyd |
| 2011/0200477 | A1 | 8/2011 | Chua |
| 2012/0023923 | A1 | 2/2012 | Peters et al. |
| 2013/0067899 | A1 | 3/2013 | Mathers |
| 2014/0062088 | A1 | 3/2014 | Carr |
| 2014/0138958 | A1 | 5/2014 | Verdegem |
| 2014/0291045 | A1 | 10/2014 | Collett et al. |
| 2014/0328709 | A1 | 11/2014 | Mathers |
| 2015/0128581 | A1 | 5/2015 | Mathers |
| 2015/0184641 | A1 | 7/2015 | Crane et al. |
| 2015/0338003 | A1 | 11/2015 | Saito et al. |
| 2016/0178014 | A1 | 6/2016 | D'angelo et al. |
| 2016/0178104 | A1 | 6/2016 | Queau et al. |
| 2016/0194959 | A1 | 7/2016 | Pekrul |
| 2018/0010676 | A1 | 1/2018 | Mathers et al. |
| 2018/0023738 | A1 | 1/2018 | Mathers |
| 2018/0094712 | A1 | 4/2018 | Mathers |
| 2018/0106152 | A1 | 4/2018 | Mathers et al. |

(56) References Cited

U.S. PATENT DOCUMENTS

| | | | |
|---|---|---|---|
| 2018/0298881 | A1 | 10/2018 | Mathers |
| 2020/0270992 | A1 | 8/2020 | Mathers |
| 2020/0332871 | A1 | 10/2020 | Mathers |
| 2020/0370692 | A1 | 11/2020 | Mathers |

FOREIGN PATENT DOCUMENTS

| | | | |
|---|---|---|---|
| AU | 2019200036 | B2 | 6/2020 |
| CN | 1047551 | A | 12/1990 |
| CN | 1186173 | A | 7/1998 |
| CN | 1226958 | A | 8/1999 |
| CN | 2388461 | Y | 7/2000 |
| CN | 1573112 | A | 2/2005 |
| CN | 1833901 | A | 9/2006 |
| CN | 1853031 | A | 10/2006 |
| CN | 2924153 | Y | 7/2007 |
| CN | 101081596 | A | 12/2007 |
| CN | 101233297 | A | 7/2008 |
| CN | 101490420 | A | 7/2009 |
| CN | 101233297 | B | 9/2010 |
| CN | 101949478 | A | 1/2011 |
| CN | 102562208 | A | 7/2012 |
| CN | 102753851 | A | 10/2012 |
| CN | 103052796 | A | 4/2013 |
| CN | 103510988 | A | 1/2014 |
| CN | 103511219 | A | 1/2014 |
| CN | 103672246 | A | 3/2014 |
| CN | 103758976 | A | 4/2014 |
| CN | 103836093 | A | 6/2014 |
| CN | 102011910 | B | 7/2014 |
| CN | 104066931 | A | 9/2014 |
| CN | 104471251 | A | 3/2015 |
| CN | 105909512 | A | 8/2016 |
| CN | 1027538518 | | 8/2016 |
| CN | 106090065 | A | 11/2016 |
| CN | 107428241 | A | 12/2017 |
| CN | 107709704 | A | 2/2018 |
| CN | 108431406 | A | 8/2018 |
| CN | 108848674 | A | 11/2018 |
| CN | 1060900656 | | 3/2019 |
| CN | 110023667 | A | 7/2019 |
| CN | 110382822 | A | 10/2019 |
| CN | 107709704 | B | 4/2020 |
| CN | 108431406 | B | 7/2020 |
| CN | 107428241 | B | 9/2020 |
| DE | 1653801 | A1 | 6/1971 |
| DE | 1728268 | A1 | 3/1972 |
| DE | 2165530 | A1 | 7/1973 |
| DE | 4136151 | A1 | 5/1993 |
| DE | 19829726 | A1 | 1/2000 |
| DE | 112007001338 | T5 | 4/2009 |
| DE | 102011082725 | A1 | 3/2013 |
| DE | 102012013152 | A1 | 1/2014 |
| EP | 0051192 | A1 | 5/1982 |
| EP | 0087401 | A1 | 8/1983 |
| EP | 0384335 | A1 | 8/1990 |
| EP | 0399387 | A2 | 11/1990 |
| EP | 0399387 | B1 | 9/1992 |
| EP | 1536138 | A1 | 6/2005 |
| EP | 1779903 | B1 | 3/2010 |
| EP | 1660756 | B1 | 5/2018 |
| EP | 3365555 | B1 | 9/2019 |
| EP | 2501950 | B1 | 5/2020 |
| EP | 3274557 | B1 | 11/2020 |
| FR | 2944071 | A3 | 10/2010 |
| GB | 1513208 | A | 6/1978 |
| GB | 2015084 | A | 9/1979 |
| GB | 2042642 | A | 9/1980 |
| GB | 2176537 | A | 12/1986 |
| GB | 2481365 | A | 12/2011 |
| IN | 5265 | | 8/2016 |
| IN | 201717028529 | A | 10/2017 |
| IN | 201717036365 | A | 12/2017 |
| IN | 201817018393 | A | 9/2018 |
| IN | 201817026903 | A | 11/2018 |
| IN | 201917006576 | A | 5/2019 |
| IN | 201917036435 | A | 11/2019 |
| JP | S5322204 | U | 2/1978 |
| JP | S55112085 | U | 8/1980 |
| JP | S62113883 | A | 5/1987 |
| JP | H05263413 | A | 10/1993 |
| JP | H0710483 | A | 1/1995 |
| JP | H07310687 | A | 11/1995 |
| JP | 2002275979 | A | 9/2002 |
| JP | 2003172272 | A | 6/2003 |
| JP | 2005351117 | A | 12/2005 |
| JP | 2008540905 | A | 11/2008 |
| JP | 2009539006 | A | 11/2009 |
| JP | 5200009 | A | 2/2013 |
| KR | 10131877461 | | 10/2013 |
| KR | 20140023133 | A | 2/2014 |
| SU | 1807460 | A1 | 4/1993 |
| WO | WO-1981001444 | A1 | 5/1981 |
| WO | WO-9111614 | A1 | 8/1991 |
| WO | WO-1991011614 | | 8/1991 |
| WO | WO-199401179 | A1 | 1/1994 |
| WO | WO-9508047 | A1 | 3/1995 |
| WO | WO-9801670 | A1 | 1/1998 |
| WO | WO-1998001670 | | 1/1998 |
| WO | WO-0204812 | A1 | 1/2002 |
| WO | WO-2004000951 | A1 | 12/2003 |
| WO | WO-2005005782 | A1 | 1/2005 |
| WO | WO-2006119574 | A1 | 11/2006 |
| WO | WO-2007140514 | A1 | 12/2007 |
| WO | WO-20110051 | | 1/2011 |
| WO | WO-2011011682 | A2 | 1/2011 |
| WO | WO-2011061630 | A2 | 5/2011 |
| WO | WO-2012015850 | A1 | 2/2012 |
| WO | WO-2013140305 | A1 | 9/2013 |
| WO | WO-2015123784 | A1 | 8/2015 |
| WO | WO-2016065392 | A1 | 5/2016 |
| WO | WO-2016116809 | A1 | 7/2016 |
| WO | WO-2016149740 | A1 | 9/2016 |
| WO | WO-2017066826 | A1 | 4/2017 |
| WO | WO-2017106909 | A1 | 6/2017 |
| WO | WO-2018014082 | A1 | 1/2018 |
| WO | WO-2018161108 | A1 | 9/2018 |
| WO | WO-2020215118 | A1 | 10/2020 |
| WO | WO-2021113907 | A1 | 6/2021 |

OTHER PUBLICATIONS

"U.S. Appl. No. 11/914,203, Preliminary Amendment filed Nov. 12, 2007", 8 pgs.

"U.S. Appl. No. 11/914,203, Response filed Nov. 29, 2010 to Restriction Requirement dated Nov. 4, 2010", 8 pgs.

"U.S. Appl. No. 11/914,203, Restriction Requirement dated Nov. 4, 2010", 7 pgs.

"U.S. Appl. No. 12/303,224 , Response filed Feb. 13, 2013 to Final Office Action dated Sep. 13, 2012", 11 pgs.

"U.S. Appl. No. 12/303,224, Final Office Action dated Sep. 13, 2012", 14 pgs.

"U.S. Appl. No. 12/303,224, Non Final Office Action dated Jan. 19, 2012", 10 pgs.

"U.S. Appl. No. 12/303,224, Notice of Allowance dated Nov. 12, 2013", 15 pgs.

"U.S. Appl. No. 12/303,224, Preliminary Amendment filed Jun. 30, 2010", 4 pgs.

"U.S. Appl. No. 12/303,224, Preliminary Amendment filed Dec. 2, 2008", 5 pgs.

"U.S. Appl. No. 12/303,224, PTO Response to 312 Communication dated Apr. 1, 2014", 2 pgs.

"U.S. Appl. No. 12/303,224, Response filed May 18, 2012 to Non Final Office Action dated Jan. 19, 2012", 8 pgs.

"U.S. Appl. No. 12/303,224, Response filed Oct. 26, 2011 to Restriction Requirement dated Oct. 5, 2011", 3 pgs.

"U.S. Appl. No. 12/303,224, Restriction Requirement dated Oct. 5, 2011", 7 pgs.

"U.S. Appl. No. 12/466,280, Non Final Office Action dated Aug. 22, 2012", 18 pgs.

(56) References Cited

OTHER PUBLICATIONS

"U.S. Appl. No. 12/466,280, Notice of Allowance dated Apr. 29, 2013", 13 pgs.
"U.S. Appl. No. 12/466,280, PTO Response to 312 Amendment dated Jul. 25, 2013", 2 pgs.
"U.S. Appl. No. 12/466,280, PTO Response to 312 Amendment dated Oct. 31, 2013", 2 pgs.
"U.S. Appl. No. 12/466,280, Response filed Feb. 22, 2013 to Non Final Office Action dated Aug. 22, 2012", 16 pgs.
"U.S. Appl. No. 12/466,280, Response filed Jun. 28, 2012 to Restriction Requirement dated May 30, 2012", 9 pgs.
"U.S. Appl. No. 12/466,280, Restriction Requirement dated May 30, 2012", 6 pgs.
"U.S. Appl. No. 13/510,643, Non Final Office Action dated Aug. 13, 2015", 9 pgs.
"U.S. Appl. No. 13/510,643, Notice of Allowance dated Mar. 23, 2016", 7 pgs.
"U.S. Appl. No. 13/510,643, Preliminary Amendment May 17, 2012", 7 pgs.
"U.S. Appl. No. 13/510,643, Response filed Feb. 15, 2016 to Non Final Office Action dated Aug. 13, 2015", 11 pgs.
"U.S. Appl. No. 14/095,654, Examiner Interview Summary dated Sep. 6, 2016", 3 pgs.
"U.S. Appl. No. 14/095,654, Examiner Interview Summary dated Nov. 23, 2015", 3 pgs.
"U.S. Appl. No. 14/095,654, Final Office Action dated Jul. 8, 2016", 10 pgs.
"U.S. Appl. No. 14/095,654, Final Office Action dated Oct. 19, 2015", 24 pgs.
"U.S. Appl. No. 14/095,654, Non Final Office Action dated Feb. 11, 2016", 17 pgs.
"U.S. Appl. No. 14/095,654, Non Final Office Action dated Nov. 6, 2014", 14 pgs.
"U.S. Appl. No. 14/095,654, Notice of Allowance dated Sep. 26, 2016", 5 pgs.
"U.S. Appl. No. 14/095,654, PTO Response to Rule 312 Communication dated Apr. 5, 2017", 2 pgs.
"U.S. Appl. No. 14/095,654, Response filed Jan. 19, 2016 to Final Office Action dated Oct. 19, 2015", 14 pgs.
"U.S. Appl. No. 14/095,654, Response filed Apr. 6, 2015 to Non Final Office Action dated Nov. 6, 2014", 12 pgs.
"U.S. Appl. No. 14/095,654, Response filed May 9, 2016 to Non Final Office Action dated Feb. 11, 2016", 11 pgs.
"U.S. Appl. No. 14/095,654, Response filed Aug. 27, 2015 to Restriction Requirement dated May 29, 2015", 6 pgs.
"U.S. Appl. No. 14/095,654, Response filed Sep. 7, 2016 to Final Office Action dated Jul. 8, 2016", 8 pgs.
"U.S. Appl. No. 14/095,654, Restriction Requirement dated May 29, 2015", 6 pgs.
"U.S. Appl. No. 14/599,746, Non Final Office Action dated Apr. 19, 2017", 10 pgs.
"U.S. Appl. No. 14/599,746, Notice of Allowance dated Sep. 13, 2017", 7 pgs.
"U.S. Appl. No. 14/599,746, Preliminary Amendment filed Jan. 20, 2015", 6 pgs.
"U.S. Appl. No. 14/599,746, Response filed Jul. 19, 2017 to Non Final Office Action dated Apr. 19, 2017", 12 pgs.
"U.S. Appl. No. 15/544,829, Preliminary Amendment, dated Jul. 19, 2017", 3 pgs.
"U.S. Appl. No. 15/561,410, Corrected Notice of Allowability dated Sep. 3, 2019", 2 pgs.
"U.S. Appl. No. 15/561,410, Corrected Notice of Allowability dated Sep. 12, 2019", 2 pgs.
"U.S. Appl. No. 15/561,410, Non Final Office Action dated Mar. 22, 2019", 10 pgs.
"U.S. Appl. No. 15/561,410, Notice of Allowance dated Jul. 17, 2019", 5 pgs.
"U.S. Appl. No. 15/561,410, Preliminary Amendment filed Sep. 25, 2017", 10 pgs.
"U.S. Appl. No. 15/561,410, Response filed Jun. 21, 2019 to Non-Final Office Action dated Mar. 22, 2019", 10 pgs.
"U.S. Appl. No. 15/654,418, Non Final Office Action dated Oct. 15, 2019", 7 pgs.
"U.S. Appl. No. 15/654,418, Response filed Jan. 15, 2020 to Non Final Office Action dated Oct. 15, 2019", 14 pgs.
"U.S. Appl. No. 15/654,418, Response filed Jul. 26, 2019 to Restriction Requirement dated May 30, 2019", 8 pgs.
"U.S. Appl. No. 15/654,418, Restriction Requirement dated May 30, 2019", 5 pgs.
"U.S. Appl. No. 15/767,902, Non Final Office Action dated Jan. 28, 2019", 6 pgs.
"U.S. Appl. No. 15/767,902, Notice of Allowability dated Aug. 12, 2019", 2 pgs.
"U.S. Appl. No. 15/767,902, Notice of Allowance dated May 24, 2019", 5 pgs.
"U.S. Appl. No. 15/767,902, Preliminary Amendment filed Apr. 12, 2018", 10 pgs.
"U.S. Appl. No. 15/767,902, Response filed Apr. 19, 2019 to Non Final Office Action dated Jan. 28, 2019", 11 pgs.
"U.S. Appl. No. 15/835,058, Non Final Office Action dated Aug. 6, 2019", 11 pgs.
"U.S. Appl. No. 15/835,058, Notice of Allowance dated Jan. 31, 2020", 7 pgs.
"U.S. Appl. No. 15/835,058, Preliminary Amendment filed Jan. 5, 2018", 8 pgs.
"U.S. Appl. No. 15/835,058, Response filed Nov. 6, 2019 to Non-Final Office Action dated Aug. 6, 2019", 17 pgs.
"U.S. Appl. No. 16/063,822, Preliminary Amendment filed Jun. 19, 2018", 8 pgs.
"Application Serial No. PCT/AU2015/000639, Invitation to Pay Additional Fees and Partial Search Report dated Nov. 6, 2015", 2 pgs.
"Australian Application Serial No. 2010320606, First Examination Report dated Jul. 5, 2016", 3 pgs.
"Australian Application Serial No. 2010320606, Response filed Jan. 4, 2017 to First Examination Report dated Jul. 5, 2016", 14 pgs.
"Australian Application Serial No. 2017202300, First Examination Report dated Jun. 14, 2018", 4 pgs.
"Australian Application Serial No. 2017202300, Response filed Sep. 7, 2018 to First Examination Report dated Jun. 14, 2018", 6 pgs.
"Chinese Application Serial No. 200680025085.2, Office Action dated Oct. 17, 2008", (w/English Translation), 10 pgs.
"Chinese Application Serial No. 201080052336.2 Response filed Nov. 6, 2014 to Final Office Action dated Apr. 21, 2014", (w/ English Translation of Claims), 14 pgs.
"Chinese Application Serial No. 201080052336.2, Office Action dated Feb. 9, 2015", (w/English Translation), 9 pgs.
"Chinese Application Serial No. 201080052336.2, Office Action dated Apr. 21, 2014", (w/English Translation), 12 pgs.
"Chinese Application Serial No. 201080052336.2, Office Action dated Oct. 13, 2015", with English translation of claims, 7 pgs.
"Chinese Application Serial No. 201080052336.2, Response filed Feb. 29, 2016 to Office Action dated Oct. 13, 2015", with English translation of claims, 8 pgs.
"Chinese Application Serial No. 201080052336.2, Response filed Jun. 24, 2015 to Office Action dated Feb. 9, 2015", (w/ English Translation of Claims), 12 pgs.
"Chinese Application Serial No. 201610605209.X, Office Action dated Jan. 11, 2018", W/English Translation, 12 pgs.
"Chinese Application Serial No. 201610605209.X, Office Action dated Sep. 30, 2018", w/English translation, 12 pgs.
"Chinese Application Serial No. 201610605209.X, Response Filed Jan. 11, 2019 to Examiner Interview Jan. 8, 2019", with machine translation, 30 pgs.
"Chinese Application Serial No. 201610605209.X, Response filed May 25, 2018 to Office Action dated Jan. 11, 2018", with machine translation, 18 pgs.
"Chinese Application Serial No. 201610605209.X, Response Filed Nov. 19, 2018 to Office Action dated Sep. 30, 2018", with English translation of claims, 9 pgs.

(56) References Cited

OTHER PUBLICATIONS

"Chinese Application Serial No. 201680012390.1, Office Action dated Jun. 17, 2019", w/English translation, 25 pgs.
"Chinese Application Serial No. 201680012390.1, Response filed Oct. 18, 2019 to Office Action dated Jun. 17, 2019", w/ English Claims, 29 pgs.
"Chinese Application Serial No. 20168003037.1, Voluntary Amendment filed", w/ English Claims, 10 pgs.
"Chinese Application Serial No. 201680030371.1, Office Action dated May 30, 2019", w/English Translation, 9 pgs.
"Chinese Application Serial No. 201680030371.1, Response filed Sep. 30, 2019 to Office Action dated May 30, 2019", w/ English Claims, 16 pgs.
"Chinese Application Serial No. 201680061659.5, Office Action dated Apr. 25, 2019", w/English translation, 18 pgs.
"Chinese Application Serial No. 201680061659.5, Office Action dated Nov. 25, 2019", w/o English Translation, 3 pgs.
"Chinese Application Serial No. 201680061659.5, Response filed Jan. 16, 2020 to Office Action dated Nov. 25, 2019", w/ English Claims, 17 pgs.
"Chinese Application Serial No. 201680061659.5, Response filed Aug. 27, 2019 to Office Action dated Apr. 25, 2019", w/ English Claims, 22 pgs.
"Chinese Application Serial No. 201680061659.5, Voluntary Amendment Filed Feb. 1, 2019", w/English Claims, 22 pgs.
"Eurasian Application Serial No. 201791637, Office Action dated Feb. 27, 2019", W/English Translation, 6 pgs.
"Eurasian Application Serial No. 201791637, Office Action dated Oct. 8, 2019", w/ English Translation, 4 pgs.
"Eurasian Application Serial No. 201791637, Response filed Jan. 16, 2020 to Office Action dated Oct. 8, 2019", w/ English Claims, 16 pgs.
"Eurasian Application Serial No. 201791637, Response filed Jun. 27, 2019 to Office Action dated Feb. 27, 2019", w/ English Claims, 15 pgs.
"Eurasian Application Serial No. 201891020, Office Action dated Oct. 21, 2019", w/ English Translation, 4 pgs.
"Eurasian Application Serial No. 201891020, Response filed Jan. 9, 2020 to Office Action dated Oct. 21, 2019", w/ English Claims, 17 pgs.
"European Application Serial No. 04761081, Supplementary Partial European Search Report dated Mar. 31, 2011", 2 pgs.
"European Application Serial No. 04761081.1, Communication Pursuant to Article 94(3) EPC dated Feb. 24, 2017", 6 pgs.
"European Application Serial No. 04761081.1, Communication Pursuant to Article 94(3) EPC dated May 31, 2016", 6 pgs.
"European Application Serial No. 04761081.1, Office Action dated Apr. 11, 2012", 7 pgs.
"European Application Serial No. 04761081.1, Response filed Feb. 4, 2013 to Office Action dated Apr. 11, 2012", 12 pgs.
"European Application Serial No. 04761081.1, Response filed May 8, 2017 to Communication Pursuant to Article 94(3) EPC dated Feb. 24, 2017", 11 pgs.
"European Application Serial No. 04761081.1, Response filed Dec. 12, 2016 to Communication Pursuant to Article 94(3) EPC dated May 31, 2016", 23 pgs.
"European Application Serial No. 04761081.1, Supplementary European Search Report dated Apr. 14, 2011", 3 pgs.
"European Application Serial No. 10831224.0, Extended European Search Report dated Feb. 6, 2018", 6 pgs.
"European Application Serial No. 10831224.0, Further Response filed Sep. 7, 2018 to Extended European Search Report dated Feb. 6, 2018", 26 pgs.
"European Application Serial No. 10831224.0, Further Response filed Oct. 5, 2018 to Extended European Search Report dated Feb. 6, 2018", 24 pgs.
"European Application Serial No. 10831224.0, Response filed Sep. 5, 2018 to Extended European Search Report dated Feb. 6, 2018", 49 pgs.
"European Application Serial No. 16739836.1, Extended European Search Report dated Sep. 6, 2018", 5 pgs.
"European Application Serial No. 16739836.1, Response Filed Jan. 11, 2019 to Extended European Search Report dated Sep. 6, 2018", 23 pgs.
"European Application Serial No. 16739836.1, Response filed Feb. 23, 2018", 8 pgs.
"European Application Serial No. 16767517.2, Communication Pursuant to Article 94(3) EPC dated Nov. 14, 2019", 4 pgs.
"European Application Serial No. 16767517.2, Extended European Search Report dated Oct. 8, 2018", 6 pgs.
"European Application Serial No. 16767517.2, Response Filed Apr. 29, 2019 to Extended European Search Report dated Oct. 8, 2018", 56 pgs.
"European Application Serial No. 16767517.2, Response filed May 7, 2018 to Communication pursuant to Rules 161(2) and 162 EPC, dated Nov. 7, 2017", 13 pgs.
"European Application Serial No. 16876998.2, Extended European Search Report dated Jun. 12, 2019", 8 pgs.
"European Application Serial No. 16876998.2, Response filed Jan. 8, 2020 to Extended European Search Report dated Jun. 12, 2019", 19 pgs.
"European Application Serial No. 16876998.2, Response filed Aug. 3, 2018", 13 pgs.
"European Application Serial No. 18763798.8, Extended European Search Report dated Dec. 5, 2019", 8 pgs.
"European Application Serial No. 16856481.3, Extended European Search Report dated Oct. 10, 2018", 5 pgs.
"European Application Serial No. 16856481.3, Response filed Feb. 28, 2019 to Extended European Search Report dated Oct. 10, 2018", 20 pgs.
"German Application Serial No. 112007001338.9, Office Action dated Jan. 20, 2017", with English translation of claims, 12 pgs.
"German Application Serial No. 11200/001338.9, Respose filed Jul. 24, 2017 to Office Action dated Jan. 20, 2017", w/o English Translation, 3 pgs.
"Germany Application Serial No. 112006001186.3, Office Action dated Nov. 20, 2015", W/English Translation, 11 pgs.
"Germany Application Serial No. 112006001186.3, Response filed Apr. 15, 2016 to Office Action dated Nov. 20, 2015", with English translation of claims, 42 pgs.
"Indian Application Serial No. 4640/KOLNP/2007, First Examiner Report dated Jul. 15, 2016", 8 pgs.
"Indian Application Serial No. 4640/KOLNP/2007, Office Action dated Aug. 7, 2017", 2 pgs.
"Indian Application Serial No. 4640/KOLNP/2007, Response filed Sep. 22, 2017 to Office Action dated Aug. 7, 2017", w/ English Translation, 16 pgs.
"Indian Application Serial No. 4640/KOLNP/2007, Response filed Jan. 10, 2017 to First Examiner Report dated Jul. 15, 2016", 11 pgs.
"Indian Application Serial No. 4859/KOLNP/2008, First Examiner Report dated Sep. 25, 2017", w/ English Translation, 6 pgs.
"Indian Application Serial No. 4859/KOLNP/2008, Response filed Mar. 23, 2018 to First Examiner Report dated Sep. 25, 2017", w/ English Translation, 8 pgs.
"Indian Application Serial No. 5265/DELNP/2012, Amendment filed Jul. 4, 2012", 8 pgs.
"Indian Application Serial No. 5265/DELNP/2 012, First Examination Report dated Sep. 20, 2018", W/ English Translation, 7 pgs.
"Indian Application Serial No. 5265/DELNP/2012, Response filed Mar. 22, 2019 to Examination Report dated Sep. 20, 2018", 22 pgs.
"International Application No. PCT/IB2010/003161, International Preliminary Report on Patentability dated May 31, 2012", (May 31, 2012), 8 pgs.
"International Application Ser. No. PCT/AU2006/000623, International Preliminary Report for Patentability dated Nov. 13, 2007", 6 pgs.
"International Application Ser. No. PCT/AU2006/000623, International Search Report dated Sep. 4, 2006", 4 pgs.
"International Application Ser. No. PCT/AU2QQ6/000623, Written Opinion dated Sep. 4, 2006", 5 pgs.
"International Application Serial No. PCT/AU2007/000772, International Search Report dated Jul. 23, 2007", 3 pgs.

(56) References Cited

OTHER PUBLICATIONS

"International Application Serial No. PCT/AU2007/000772, Written Opinion dated Jul. 23, 2007", 6 pgs.
"International Application Serial No. PCT/AU2004/000951, International Preliminary Report on Patentability dated Nov. 4, 2005", 9 pgs.
"International Application Serial No. PCT/AU2004/000951, International Search Report dated Sep. 13, 2004", 3 pgs.
"International Application Serial No. PCTIAU2004/000951, Written Opinion dated Sep. 13, 2004", 4 pgs.
"International Application Serial No. PCT/AU2007/000772, International Preliminary Report on Patentability dated Apr. 21, 2008", 6 pgs.
"International Application Serial No. PCT/AU2015/000639, International Search Report dated Dec. 17, 2015", 6 pgs.
"International Application Serial No. PCT/AU2015/000639, Written Opinion dated Dec. 17, 2015", 6 pgs.
"International Application Serial No. PCT/AU2016/000108, International Preliminary Report on Patentability dated Oct. 5, 2017", 8 pgs.
"International Application Serial No. PCT/AU2016/000108, International Search Report dated Jun. 7, 2016", 7 pgs.
"International Application Serial No. PCT/AU2016/000108, Written Opinion dated Jun. 7, 2016", 6 pgs.
"International Application Serial No. PCT/AU2016/050967, International Preliminary Report on Patentability dated May 3, 2018", 6 pgs.
"International Application Serial No. PCT/AU2016/050967, International Search Report dated Dec. 21, 2016", 9 pgs.
"International Application Serial No. PCT/AU2016/050967, Written Opinion dated Dec. 21, 2016", 4 pgs.
"International Application Serial No. PCT/AU2016/051256, International Preliminary Report on Patentability dated Jul. 5, 2018", 8 pgs.
"International Application Serial No. PCT/AU2016/051256, International Search Report dated Apr. 24, 2017", 6 pgs.
"International Application Serial No. PCT/AU2016/051256, Written Opinion dated Apr. 24, 2017", 6 pgs.
"International Application Serial No. PCT/AU2017/050744, International Preliminary Report on Patentability dated Jan. 31, 2019", 9 pgs.
"International Application Serial No. PCT/AU2017/050744, International Search Report dated Sep. 29, 2017", 4 pgs.
"International Application Serial No. PCT/AU2017/050744, Written Opinion dated Sep. 29, 2017", 7 pgs.
"International Application Serial No. PCT/AU2018/050180, International Preliminary Report on Patentability dated Sep. 19, 2019", 8 pgs.
"International Application Serial No. PCT/IB2010/003161, International Search Report and Written Opinion dated May 11, 2011", (May 11, 2011), 11 pgs.
"International Application Serial No. PCT/IB2010/003161, Written Opinion dated May 11, 2011", (May 11, 2011), 13 pgs.
"International Application Serial No. PCT/IB2016/000090, International Preliminary Report on Patentability dated Aug. 3, 2017", 6 pgs.
"International Application Serial No. PCT/IB2016/000090, International Search Report dated May 2, 2016", 4 pgs.
"International Application Serial No. PCT/IB2016/000090, Written Opinion dated May 2, 2016", 4 pgs.
"Japanese Application Serial No. 2009-512374, Notice of Allowance dated Jan. 15, 2013", 6 pgs.
"Japanese Application Serial No. 2009-512374, Office Action dated May 8, 2012", (w/ English Translation), 4 pgs.
"Japanese Application Serial No. 2009-512374, Response filed Aug. 3, 2012 to Office Action dated May 8, 2012", (w/ English Translation of Claims), 7 pgs.
"Japanese Application Serial No. 2012-539437, Voluntary Amendment filed Dec. 27, 2012", (w/English Translation of Claims), 10 pgs.
"International Application Serial No. PCT/AU2018/050180, International Search Report dated May 15, 2018", 5 pgs.
"International Application Serial No. PCT/AU2018/050180, Written Opinion dated May 15, 2018", 6 pgs.
"U.S. Appl. No. 11/331,356, Non Final Office Action dated Feb. 6, 2008", 8 pgs.
"U.S. Appl. No. 11/331,356, Response filed Aug. 4, 2008 to Non Final Office Action dated Feb. 6, 2008", 13 pgs.
"U.S. Appl. No. 11/331,356, Response filed Nov. 30, 2007 to Restriction Requirement dated Oct. 31, 2007", 1 pg.
"U.S. Appl. No. 11/331,356, Restriction Requirement dated Oct. 31, 2007", 7 pgs.
"U.S. Appl. No. 12/303,224, 312 Amendment filed Feb. 12, 2014", 6 pgs.
"U.S. Appl. No. 12/446,280, 312 Amendment dated Jun. 19, 2013", 3 pgs.
"U.S. Appl. No. 12/446,280, 312 Amendment dated Aug. 27, 2013", 3 pgs.
"U.S. Appl. No. 14/095,654, 312 Amendment filed Mar. 31, 2017", 132 pgs.
"U.S. Appl. No. 15/544,829, Notice of Allowance dated Apr. 20, 2020", 9 pgs.
"U.S. Appl. No. 15/654,418, Final Office Action dated Mar. 2, 2020", 7 pgs.
"U.S. Appl. No. 15/654,418, Notice of Allowance dated May 11, 2020", 7 pgs.
"U.S. Appl. No. 15/654,418, Response filed Apr. 24, 2020 to Final Office Action dated Mar. 2, 2020", 10 pgs.
"U.S. Appl. No. 29/099,122, Notice of Allowance dated Feb. 8, 2000", 3 pgs.
"U.S. Appl. No. 29/099,122, Office Action dated Sep. 2, 1999", 8 pgs.
"U.S. Appl. No. 29/099,122, Response filed Dec. 30, 1999 to Office Action dated Sep. 2, 1999", 6 pgs.
"Australian Application Serial No. 2019200036, First Examination Report, dated Mar. 25, 2020", 2 pgs.
"Australian Application Serial No. 2019200036, Response filed May 15, 2020 to Subsequent Examiners Report dated Apr. 8, 2020", 8 pgs.
I "Australian Application Serial No. 2019200036, Subsequent Examiners Report dated Apr. 8, 2020", 3 pgs.
"Chinese Application No. 200780026896.6, Office Action dated Jun. 29, 2010", with English translation of claims, 9 pgs.
"Chinese Application Serial No. 2004800264446.6, Response filed Oct. 20, 2008 to Office Action dated Apr. 4, 2008", with English translation of claims, 17 pgs.
"Chinese Application Serial No. 200480026446.6, Office Action dated Apr. 4, 2008", with Engiish translation of claims, 7 pgs.
"Chinese Application Serial No. 200780026806.6, Response filed Jan. 14, 2011", with English translation of claims, 26 pgs.
"Chinese Application Serial No. 201680012390.1, Office Action dated Feb. 3, 2020", w/English Translation, 24 pgs.
"Chinese Application Serial No. 201680012390.1, Response filed Mar. 26, 2020 to Office Action dated Feb. 3, 2020", w/ English Ciaims, 20 pgs.
"Chinese Application Serial No. 201780055270.4, Office Action dated Apr. 16, 2020", w/English Translation, 21 pgs.
"European Application Serial No. 16767511.2, Response filed Feb. 25, 2020 to Communication Pursuant to Article 94(3) EPC dated Nov. 14, 2019", 47 pgs.
"European Application Serial No. 18/63798.8, Response filed May 28, 2020 to Office Action dated Jan. 3, 2020", 19 pgs.
"Japanese Application Serial No. 2005-510364, Office Action dated Aug. 9, 2012", with English translation of claims, 4 pgs.
"Japanese Application Serial No. 2008-510364, Office Action dated Sep. 13, 2011", with English translation of claims, 10 pgs.
"Japanese Application Serial No. 2008-510364, Response filed Mar. 15, 2012", with English translation of claims, 13 pgs.
U.S. Appl. No. 16/990,789, filed Aug. 11, 2020, Hydraulic Joint.
U.S. Appl. No. 16/867,943, filed May 6, 2020, Hydrostatic Torque Converter and Torque Amplifier.
"U.S. Appl. No. 16/063,822, Advisory Action dated Feb. 8, 2021", 3 pgs.

(56) References Cited

OTHER PUBLICATIONS

"U.S. Appl. No. 16/063,822, Final Office Action dated Nov. 27, 2020", 19 pgs.
"U.S. Appl. No. 16/063,822, Response filed Jan. 25, 2021 to Final Office Action dated Nov. 27, 2020", 13 pgs.
"Australian Application Serial No. 2016343296, Response filed Oct. 1, 2020 to First Examination Report dated Jul. 10, 2020", 33 pgs.
"Australian Application Serial No. 2016343296, Subsequent Examiners Report dated Oct. 2, 2020", 2 pgs.
"Chinese Application Serial No. 201780055270.4, Office Action dated Nov. 24, 2020", with machine translation, 6 pgs.
"Chinese Application Serial No. 201780055270.4, Response filed Jan. 20, 2021 to Office Action dated Nov. 24, 2020", w/ English Claims, 31 pgs.
"Eurasian Application Serial No. 201891483, Response filed Oct. 12, 2020 to Office Action dated Jun. 8, 2020", w/ English Claims, 15 pgs.
"German Application Serial No. 112006001186.3, Office Action dated Nov. 14, 2020", w/English Translation, 9 pgs.
"Indian Applicaiton Serial No. 201817018393, First Examination Report dated Nov. 4, 2020", w/ English Translation, 6 pgs.
"Indian Application Serial No. 201717028529, Response filed Feb. 17, 2021 to First Examination Report dated Aug. 31, 2020", w/ English claims, 25 pgs.
"Indian Application Serial No. 201717036365, Response filed Jan. 18, 2021 to Office Action dated Aug. 17, 2020", 23 pgs.
"Indian Application Serial No. 201817026903, Response filed Jan. 11, 2021 to First Examination Report dated Jul. 30, 2020", 20 pgs.
"U.S. Appl. No. 16/867,943, Notice of Allowance dated Jul. 9, 2021", 8 pgs.
"Chinese Application Serial No. 201780055270.4, Response filed Apr. 13, 2021 to Telephone Consultation on Apr. 7, 2021", with machine translation, 39 pgs.
"Chinese Application Serial No. 201880015900.X, Office Action dated Aug. 4, 2021", with English translation, 12 pgs.
"European Application Serial No. 16739836.1, Communication Pursuant to Article 94(3) EPC dated Jul. 29, 2021", 7 pgs.
"Indian Application Serial No. 201917006576, Response filed May 14, 2021 to First Examination Report, dated Feb. 26, 2021", 40 pg.
"Indian Application Serial No. 201917036435, First Examination Report dated Jul. 28, 2021", w/ English Translation, 10 pgs.
"U.S. Appl. No. 16/867,943, Non Final Office Action dated Mar. 22, 2021", 7 pgs.
"U.S. Appl. No. 16/867,943, Response filed Jun. 21, 2021 to Non Final Office Action dated Mar. 22, 2021", 8 pgs.
"Chinese Application Serial No. 201880015900.X, Office Action dated Jan. 27, 2021", w/English Translation, 17 pgs.
"Chinese Application Serial No. 201880015900.X, Response filed Mar. 30, 2021 to Office Action dated Jan. 27, 2021", w/ English claims, 20 pgs.
"U.S. Appl. No. 15/544,829, 312 Amendment filed Jul. 17, 2020", 7 pgs.
"U.S. Appl. No. 15/544,829, PTO Response to Rule 312 Communication dated Jul. 31, 2020", 2 pgs.
"U.S. Appl. No. 16/063,822, Examiner Interview Summary dated Sep. 24, 2020", 5 pgs.
"U.S. Appl. No. 16/063,822, Non Final Office Action dated Jun. 24, 2020", 13 pgs.
"U.S. Appl. No. 16/063,822, Response filed Sep. 23, 2020 to Non Final Office Action dated Jun. 24, 2020", 19 pgs.
"U.S. Appl. No. 16/687,943, Preliminary Amendment filed Jul. 8, 2020", 6 pgs.
"U.S. Appl. No. 16/990,789, Preliminary Amendment filed Sep. 16, 2020", 7 pgs.
"Australian Application Serial No. 2016343296, First Examination Report dated Jul. 10, 2020", 4 pgs.
"Chinese Application Serial No. 201680074851.8, Office Action dated Apr. 24, 2020", w/English Translation, 25 pgs.
"Chinese Application Serial No. 201680074851.8, Response filed Aug. 6, 2020 to Office Action dated Apr. 24, 2020", w/ English Claims, 43 pgs.
"Chinese Application Serial No. 201780055270.4, Response filed Aug. 11, 2020 to Office Action dated Apr. 16, 2020", w/ English Claims, 24 pgs.
"Eurasian Application Serial No. 201791637, Office Action dated May 15, 2020", w/ English Translation, 7 pgs.
"Eurasian Application Serial No. 201791637, Response filed Sep. 16, 2020 to Office Action dated May 15, 2020", w/ English Claims, 48 pgs.
"Eurasian Application Serial No. 201891483, Office Action dated Jun. 8, 2020", w/ English Translation, 4 pgs.
"Eurasian Application Serial No. 201891483, Response filed Jan. 22, 2020 to Office Action dated Sep. 27, 2019", w/ English Claims, 7 pgs.
"European Application Serial No. 20175416.5, Extended European Search Report dated Sep. 9, 2020", 6 pgs.
"Indian Application Serial No. 201717028529, First Examination Report dated Aug. 31, 2020", w/ English Translation, 6 pgs.
"Indian Application Serial No. 201717036365, Office Action dated Aug. 17, 2020", w/ English Translation, 5 pgs.
"Indian Application Serial No. 201817026903, First Examination Report dated Jul. 30, 2020", w/ English Translation, 7 pgs.
"International Application Serial No. PCT/AU2020/050389, International Search Report dated Jun. 22, 2020", 4 pgs.
"International Application Serial No. PCT/AU2020/050389, Written Opinion dated Jun. 22, 2020", 6 pgs.
"Chinese Application Serial No. 201880015900.X, Response filed Sep. 26, 2021 to Office Action dated Aug. 4, 2021", with machine translation, 28 pgs.

| Condition | Vane Type | Pressure | Rotor RPM | Roller Force F(Kg) | Roller RPM | Result |
|---|---|---|---|---|---|---|
| 1 | Type 1 | 3000 | 2000 | 704.15 | 47350 | X (Force too Big) |
| 2 | Type 1 | 3000 | 2500 | 704.15 | 59188 | |
| 3 | Type 1 | 3500 | 2000 | 821.51 | 47350 | |
| 4 | Type 1 | 3500 | 2500 | 821.51 | 59188 | |
| 5 | Type 1 | 4500 | 2000 | 1058.23 | 47350 | |
| 6 | Type 1 | 4500 | 2500 | 1058.23 | 59188 | |
| 7 | Type 2 | 3000 | 2000 | 352.08 | 47350 | √ |
| 8 | Type 2 | 3000 | 2500 | 352.08 | 59188 | |
| 9 | Type 2 | 3500 | 2000 | 410.75 | 47350 | |
| 10 | Type 2 | 3500 | 2500 | 410.75 | 59188 | |
| 11 | Type 2 | 4500 | 2000 | 528.11 | 47350 | |
| 12 | Type 2 | 4500 | 2500 | 528.11 | 59188 | |
| 13 | Type 3 | 3000 | 2000 | 469.43 | 75760 | X (Roller Small) |
| 14 | Type 3 | 3000 | 2500 | 469.43 | 94700 | |
| 15 | Type 3 | 3500 | 2000 | 547.67 | 75760 | |
| 16 | Type 3 | 3500 | 2500 | 547.67 | 94700 | |
| 17 | Type 3 | 4500 | 2000 | 704.15 | 75760 | |
| 18 | Type 3 | 4500 | 2500 | 704.15 | 94700 | |
| 19 | Type 4 | 3000 | 2000 | 234.72 | 75760 | X (Roller Small) |
| 20 | Type 4 | 3000 | 2500 | 234.72 | 94700 | |
| 21 | Type 4 | 3500 | 2000 | 273.84 | 75760 | |
| 22 | Type 4 | 3500 | 2500 | 273.84 | 94700 | |
| 23 | Type 4 | 4500 | 2000 | 352.08 | 75760 | |
| 24 | Type 4 | 4500 | 2500 | 352.08 | 94700 | |
| 25 | Type 5 | 3000 | 2000 | 175.85 | 47350 | √ |
| 26 | Type 5 | 3000 | 2500 | 175.85 | 59188 | |
| 27 | Type 5 | 3500 | 2000 | 205.18 | 47350 | |
| 28 | Type 5 | 3500 | 2500 | 205.18 | 59188 | |
| 29 | Type 5 | 4500 | 2000 | 263.77 | 47350 | |
| 30 | Type 5 | 4500 | 2500 | 263.77 | 59188 | |

FIG. 26

HYDRAULIC MACHINE WITH STEPPED ROLLER VANE AND FLUID POWER SYSTEM INCLUDING HYDRAULIC MACHINE WITH STARTER MOTOR CAPABILITY

PRIORITY CLAIM

This application is a U.S. National Stage Filing under 35 U.S.C. 371 from International Application No. PCT/AU2018/050180, filed on Feb. 28, 2018, and published as WO 2018/161108 on Sep. 13, 2018, which application claims priority to U.S. Provisional Application No. 62/467,658, entitled "HYDRAULIC MACHINE WITH STEPPED ROLLER VANE AND FLUID POWER SYSTEM INCLUDING HYDRAULIC MACHINE WITH STARTER MOTOR CAPABILITY", filed Mar. 6, 2017 and U.S. Provisional Application No. 62/504,283, entitled "HYDRAULIC MACHINE WITH STEPPED ROLLER VANE AND FLUID POWER SYSTEM INCLUDING HYDRAULIC MACHINE WITH STARTER MOTOR CAPABILITY", filed May 10, 2017, the entire specifications of each of which are incorporated herein by reference in their entirety.

CROSS REFERENCE TO RELATED APPLICATIONS

The present application claims priority to U.S. Provisional Application 62/504,283, entitled "HYDRAULIC MACHINE WITH STEPPED ROLLER VANE AND FLUID POWER SYSTEM INCLUDING HYDRAULIC MACHINE WITH STARTER MOTOR CAPABILITY", filed May 10, 2017, and U.S. Provisional Application 62/467,658, entitled "HYDRAULIC MACHINE WITH STEPPED ROLLER VANE AND FLUID POWER SYSTEM INCLUDING HYDRAULIC MACHINE STARTER MOTOR CAPABILITY", filed Mar. 6, 2017, the entire specifications of each of which are incorporated herein by reference in their entirety.

The present application related to international application no. PCT/AU2007/000772, publication no. WO/2007/140514, entitled "Vane Pump for Pumping Hydraulic Fluid," filed Jun. 1, 2007; international application no. PCT/AU2006/000623, publication no. WO/2006/119574, entitled "Improved Vane Pump," filed May 12, 2006; international application no. PCT/AU2004/00951, publication no. WO/2005/005782, entitled "A Hydraulic Machine," filed Jul. 15, 2004; and U.S. patent application Ser. No. 13/510,643, publication no. U.S. 2013/0067899, entitled "Hydraulically Controlled Rotator Couple," filed Dec. 5, 2012, the entire specification of each of which is incorporated herein by reference in their entirety.

TECHNICAL FIELD

The present patent application relates generally to hydraulic devices, and more particularly, to hydraulic machines that include stepped roller vanes.

BACKGROUND

Hydraulic vane pumps are used to pump hydraulic fluid in many different types of machines for different purposes. Such machines include, for example, transportation vehicles, agricultural machines, industrial machines, wind turbines, and marine vehicles (e.g., trawlers).

Rotary couplings are also utilized in transportation vehicles, industrial machines, and agricultural machines to transmit rotating mechanical power. For example, they have been used in automobile transmissions as an alternative to a mechanical clutch. Use of rotary couplings is also widespread in applications where variable speed operation and controlled start-up.

OVERVIEW

The present inventors have recognized that hydraulic devices with vanes can offer improved power density and service life as compared to traditional variable piston pump/motor hydraulic devices and indeed even standard vane pumps or motors. A drawback of standard vanes in a vane pump or vane motor is the restriction of the rubbing force between a vane tip and a ring contour. This is restricted by speed and pressure as the vane tip penetrates the oil film that lubricates between the tip and the ring. When the oil film is penetrated there is no lubrication between the surfaces and a failure can occur. The presently disclosed hydraulic devices and systems utilize a hydrostatically lubricated roller bearing which removes the rubbing motion between the vane and the ring contour. Thus, improved performance and longer operational life can result from the presently disclosed designs. This is because the vanes tip is no longer sensitive to speed and pressure. With additional design changes disclosed herein, the presently discussed devices (e.g., hydraulic couplings that can be operated as a pump and motor) can run at a higher pressure.

According to some examples, the roller can be fed pressurized oil between the roller surface and the vane main body to create a hydrostatic bearing which allows the roller to rotate freely in the vane tip. According to further examples, the vane tip can be manufactured in a way that the roller is retained by the vane main body and cannot separate. Thus, the vane main body does not come into contact with the ring contour or allow hydrostatic pressure oil an easy escape pathway. Such manufacture can include that the roller is installed by sliding it into the machined cavity in the vane main body. The side plates can be designed so that while the vane follows the ring contour on rotation there is no area for the roller to escape.

According to yet further examples, the roller can be designed such that it does not have a leading edge as with standard vanes (this can be due to the fitting of the vane into the cavity as previously described), and consequently, there is a greater inward force from pressure and a dynamic force from accelerating the oil in the suction quadrants. To counterbalance these forces, and to maintain contact with the ring contour, a larger under vane pressurized area is required, which can be achieved by a stepped vane design.

More particularly, the present inventor has recognized that it is possible with a stepped vane to maintain vane integrity and exceed the inward force. In particular, the inventor has recognized that although it is possible to supply outlet pressure to the entire area under the vane however this puts unnecessary loading on the roller and ring contour and also reduces the rated flow of the pump and power density. By utilizing the stepped vane, requirements such as meeting the outward force requirement, retaining the power density and keeping the vane integrity for high pressure operation can all be met.

Further examples disclosed herein include the present hydraulic device can be used as one or more of a starter motor, a hydraulic coupling, a motor, or a vane pump. During starter motor mode of operation, a pilot signal can be sent to the step under the vane to push the vane out against the ring contour as desired. The hydraulic device can be used as part of a system that can include an accumulator to operate the present hydraulic devices as the starter motor to start the engine at higher speed then normal. This high speed start can prevent or reduce instances of over fueling that occurs from the normal low speed starter motor systems.

U.S. patent application Ser. No. 13/510,643, describes a hydraulically controllable coupling configured to couple a rotating input to an output to rotate. The present hydraulic devices can have such functionality. Furthermore, the present hydraulic device can also be switched to act as a vane pump and operation between a pumping mode and a mode in which it does not pump. U.S. Provisional Patent Application Ser. No. 62/104,975 also describes systems and methods using a plurality of hydraulic devices each configured to be operable as a hydraulic coupling and as a vane pump. The entire specification of each of the U.S. patent application Ser. No. 13/510,643 and the U.S. Provisional Patent Application Ser. No. 62/104,975 are incorporated herein by reference in entirety.

The hydraulic devices described herein can be utilized with various systems, such as those described in U.S. patent application Ser. No. 62/104,975. The hydraulic devices described herein can be used with various accessories including a hydraulic pump motor, an accumulator, and various vehicle auxiliary systems and can be utilized as part of systems that have various operation modes including tandem torque amplifying wheel drive mode, a tandem steady state wheel drive mode, a tandem vane pumping mode, a regenerative energy storage mode, and a regenerative energy application mode as described in U.S. patent application Ser. No. 62/104,975. The devices can provide operational flexibility, being selectively non-operable, selectively operable as only a vane pump (e.g. in a maximum pump mode), operable as only a hydraulic coupling (e.g., in a maximum drive mode), operable as both a vane pump and a hydraulic coupling (e.g., in a variable pump and drive mode), and operable as a vane pump with a variable displacement (e.g., in a variable displacement mode).

As used herein the term "vehicle" means virtually all types of vehicles such as earth moving equipment (e.g., wheel loaders, mini-loaders, backhoes, dump trucks, crane trucks, transit mixers, etc.), waste recovery vehicles, marine vehicles, industrial equipment (e.g., agricultural equipment), personal vehicles, public transportation vehicles, and commercial road vehicles (e.g., heavy road trucks, semi-trucks, etc.).

These and other examples and features of the present devices, systems, and methods will be set forth in part in the following Detailed Description. This overview is intended to provide a summary of subject matter of the present patent application. It is not intended to provide an exclusive or exhaustive removal of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 26 shows a table of experimental results using the various vane configurations of FIGS. 21-25 under different operating conditions.

DETAILED DESCRIPTION

The present application relates to roller vane hydraulic devices that utilize a stepped vane configuration. Furthermore, the application relates to systems that use hydraulic devices in combination with other components including a starter motor. Other aspects of the present devices and systems will be discussed or will be apparent to those of ordinary skill in the pertinent art.

Figure 1:
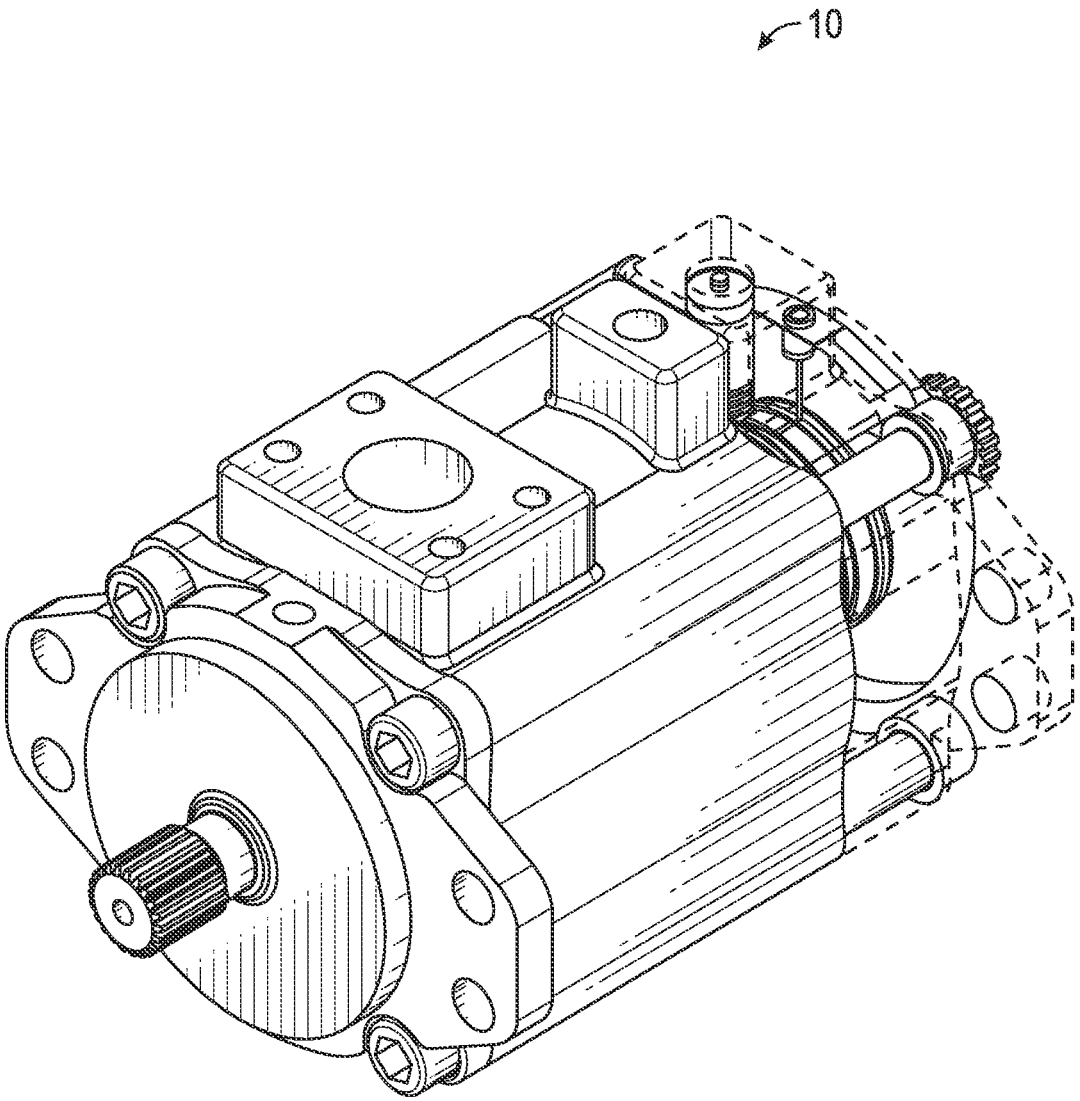
FIG. 1 is a perspective view a hydraulic device including a starter motor according to an example of the present application.
Figure 1A:
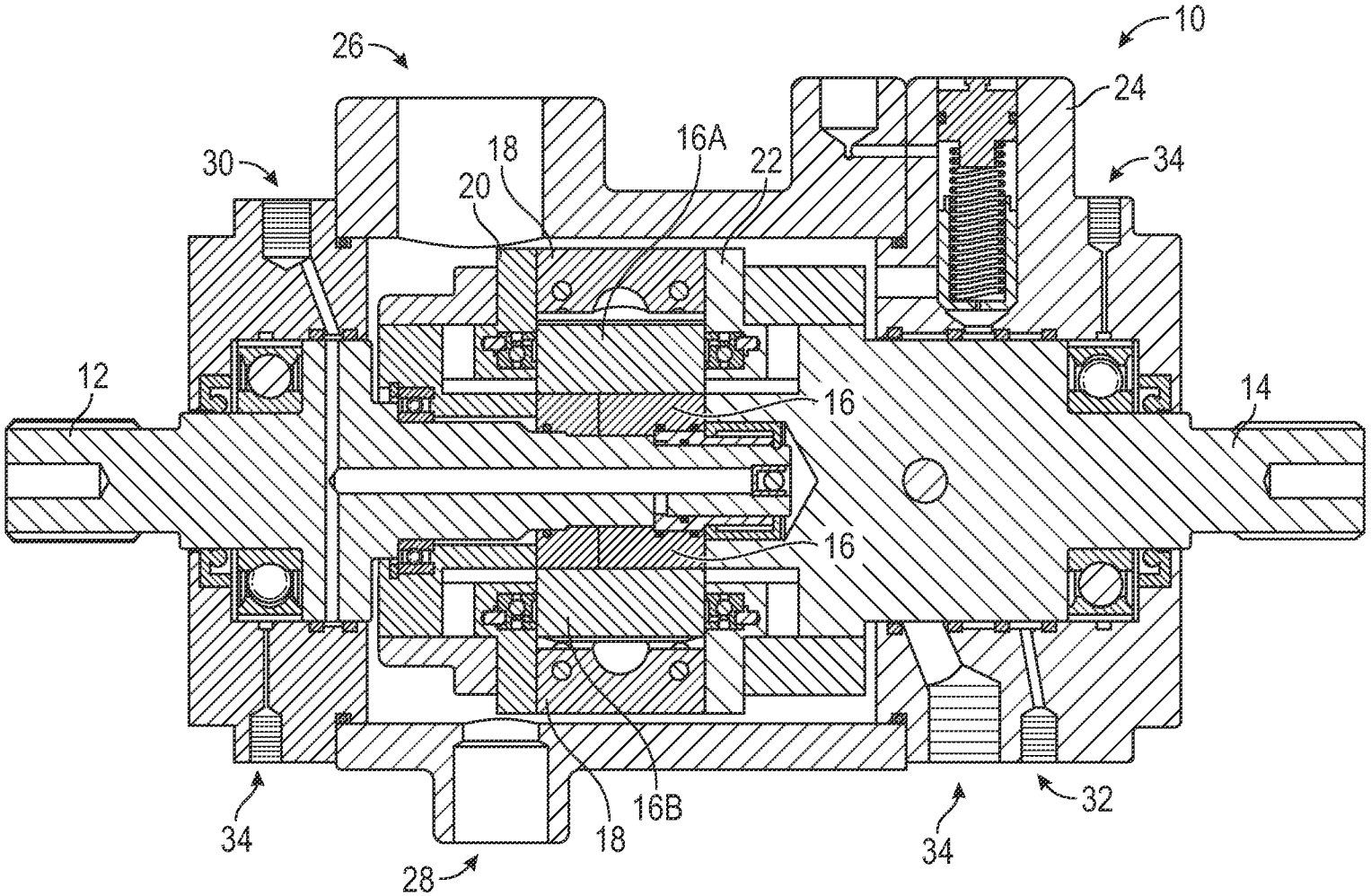
FIG. 1A is a cross section of the hydraulic device of FIG. 1 taken along a vertical line according to an example of the present application.
Figure 1B:
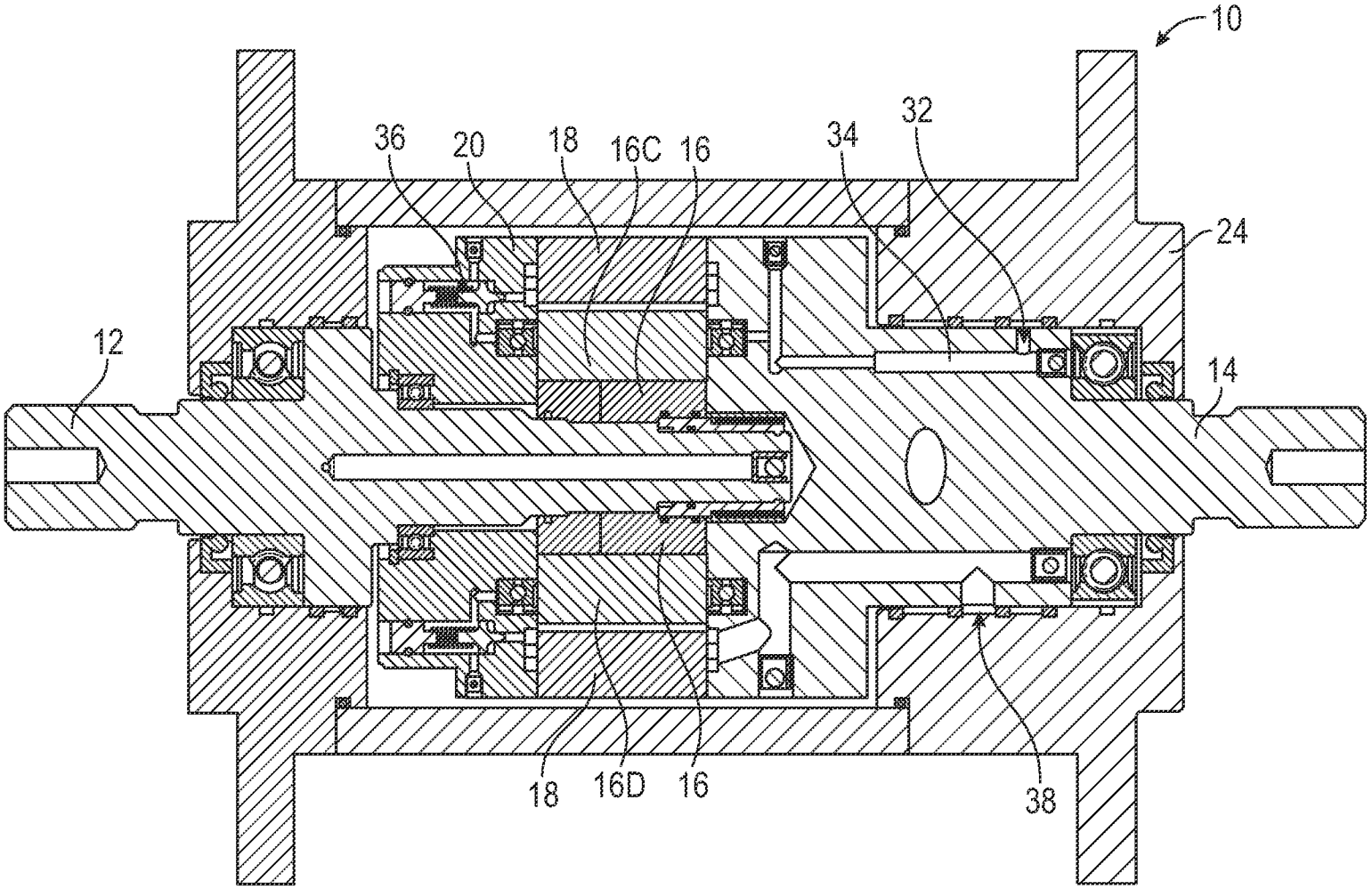
FIG. 1B is a cross section of the hydraulic device of FIG. 1 taken along a horizontal line according to an example of the present application.

FIGS. 1-1B show an exemplary hydraulic device 10 for hydraulic pumping and/or torque transfer as a hydraulic coupling. In FIGS. 1 and 1A, the hydraulic device 10 comprises a variable vane hydraulic device. Further information on the construction and operation of vane hydraulic devices can be found, for example, in United States Patent Application Publication 2013/0067899A1 and U.S. Pat. Nos. 7,955,062, 8,597,002, and 8,708,679 owned by the Applicant and incorporated herein by reference.

As shown in FIG. 1A, the hydraulic device 10 can include an input shaft 12, an output shaft 14, a rotor 16, a first stepped vane 16A and second stepped vane 16B, a ring 18, a front plate 20, a rear plate 22, a housing 24, a first inlet 26, a second inlet 28, a third inlet 30, one or more starter motor inlets 32, and drains/outlets 34.

As shown in FIG. 1A, the input shaft 12 can extend into the hydraulic device 10 and can extend to adjacent the output shaft 14. The rotor 16 can be coupled for rotation with the input shaft 12. The ring 18 can be disposed at least partially around the rotor 16 (e.g., can interface therewith). The front plate 20 can be disposed about the input shaft 12 axially adjacent to the rotor 16 and the ring 18. The rear plate 22 can be disposed about or can comprise part of the output shaft 14 axially adjacent the rotor 16 and the ring 18. The housing 24 (e.g., mid-body, front housing and rear housing) can be disposed about various of the components illustrated including the ring 18. The first inlet 26 can comprise a port in the housing 24 that can additionally be defined by front plate 20, the ring 18, and the rotor 16. The second inlet 28 can comprise a port in the housing 24 that can additionally be defined by the front plate 20, the ring 18, and the rotor 16. As will be discussed and illustrated subsequently, the first inlet 26 can be used to receive hydraulic fluid during pump mode operation. The second inlet 28 can be used during motor mode operation. Similarly, the third inlet 30 can be defined by the housing 24, the input shaft 12, the ring 18, and the rotor 16 and can be used to provide a clamping force to lock the stepped vanes 16A and 16B in a retracted position. The starter motor inlet 32 can be defined by the housing 24, the output shaft 14, the ring 18, and the rotor 16 and can be used to direct flow to push the stepped vanes 16A and 16B out under a motor mode of operation. Various other control ports not specifically number are provided to provide for hydraulic control of the device 10. Drains/outlets 34 are provided to receive flow of hydraulic fluid from components such as bearings other components within the housing.

The rotor 16 can be disposed for rotation about an axis (same axis of rotation as the input shaft 12). As used herein, the terms "radial" and "axial" are made in reference to axis that extends along the input shaft 12. As will be illustrated in subsequent FIGURES, the rotor 16 can have a plurality of circumferentially spaced slots. The slots can be configured to house a plurality of vanes including the first stepped vane 16A and the second stepped vane 16B therein. In some cases, the plurality of stepped vanes (including the first stepped vane 16A and the stepped second vane 16B) can be configured to be radially movable between a retracted position and an extended position where the plurality of stepped vanes work a hydraulic fluid introduced adjacent the rotor 16 (e.g., in a cavity defined between the rotor 16 and the ring 18). In other embodiments, the position of the stepped vanes 16A, 16B can be fixed relative to the rotor 16.

The ring 18 and the rotor 16 can be in selective communication with various of the inlets 26, 28, 30 and 32 to allow for ingress and (drains/outlets 34 egress) of the hydraulic fluid to or from adjacent the rotor 16. As will be discussed in further detail subsequently, the rotor 16 can include undervane passages some of which communicate with a step of each of the stepped vanes to facilitate movement of the stepped vanes (e.g., including the first stepped vane 16A and the second stepped vane 16B) to and from the retracted position within the rotor 16 to an extended position contacting the ring 18.

The input shaft 12 can be to a torque source (e.g. an engine, motor, or the like). In some cases, a starter motor mode is desired. In such cases, the one or more starter motor inlets 32 can be utilized. The output shaft 14 can be held stationary by locking assembly and hydraulic fluid pressurized using energy from a source such as an accumulator (FIG. 21) can be used to extend the stepped vanes causing the torque source turn over.

The output shaft 14 can be coupled to a powertrain. In operation, the ring 18 can define a cavity (also referred to as a chamber) (shown in FIGS. 3-7) in fluid communication with an inlet and a discharge pressure of the hydraulic device 10. According to the illustrated example of FIG. 1A, a rotating group that includes the rotor 16 and the input shaft 10 are configured to rotate around the axis inside the cavity (FIGS. 3-7). The rotor 16, in a variable vane configuration, can define a plurality of slots extending generally parallel to the axis along an exterior of the rotor and opening to the cavity and adapted to receive and retain the plurality of vanes including the first vane 16A and second vane 16B. Various examples can include a hydraulically controlled retainer (shown subsequently in FIG. 13) disposed in a retainer passage to retain the plurality of stepped vanes in a retracted vane mode of operation and to release the first vane in a vane extended mode of operation in which the plurality of vanes extend to meet the ring 18 to work the hydraulic fluid. Thus, in some embodiments, the plurality of stepped vanes including the first stepped vane 16A and the second stepped vane 16B are radially moveable with respect to the rotor 16 and the ring 18.

In various examples, the output shaft 14 is provided with torque as a result of the worked hydraulic fluid in the vane extended mode of operation. The operation modes can be controlled, for example, via a fluid signal transmitted to the hydraulic device 10 via an inlet/port (e.g., one of the inlets 26, 28, 30, 32 or another port). As discussed previously, the concepts discussed herein are also applicable to a fixed stepped vane configuration where the stepped vanes have a fixed height relative to the rotor 16.

In various examples, the hydraulic fluid can comprise any of oil, glycol, water/glycol, or other hydraulic fluid into and out of the hydraulic device. In some examples, fluid can to flow to and/or from a separate reservoir or source. For example, pressurized fluid from an accumulator can be used to operate the hydraulic device 10 as a starter motor as described above. Alternatively, some examples use a large housing that can accommodate enough fluid for operation and cooling. In some examples, the inlets 26, 28, 30, and 32 can variously be used to engage and disengage the plurality of stepped vanes with the ring 18 and to drive, restrain (via the locking mechanism) and release the plurality of stepped vanes relative to the rotor 16. One example of vane retraction or release is set forth in US Patent Application Publication No. 2006/0133946, commonly assigned and incorporated herein by reference. Release of the plurality of stepped vanes will result in the operation of the hydraulic device 10 as a couple, motor and/or as a hydraulic pump as is discussed in further detail in one or more of the previously incorporated references. Hydraulic pressure to various of the inlets, 26, 28, 30, 32 and cavities can be controlled through pressure regulators, poppet valves or other known methods. Control of pressure in the hydraulic device 10 can be effected by, for example, controlling a balanced piston as described in U.S. Patent Application Publication No. 2013/00067899.

FIG. 1B shows a second cross-section of the hydraulic device 10 along another plane. Thus, FIG. 1B shows many of the components previously discussed with regard to FIG. 1A including the input shaft 12, the output shaft 14, the rotor 16, a third stepped vane 16C and a fourth stepped vane 16D, the ring 18, the front plate 20, the housing 24, and the one or more starter motor inlets 32.

FIG. 1B shows the one or more starter motor inlets 32 can comprise a passages 34 that pass through the output shaft 14 and communicate with the ring 18 and the rotor 16 to facilitate starter motor mode of operation by pushing the stepped vanes outward from the rotor 16 to contact the ring 18 as previously described. FIG. 1B also further illustrates one or more poppet valves 36 that can be used in some embodiments to regulate hydraulic fluid flow within the hydraulic device 10 including to stop or restrict flow to the vane step (illustrated subsequently). A control inlet 38 is also illustrated in FIG. 1B.

Figure 2A:
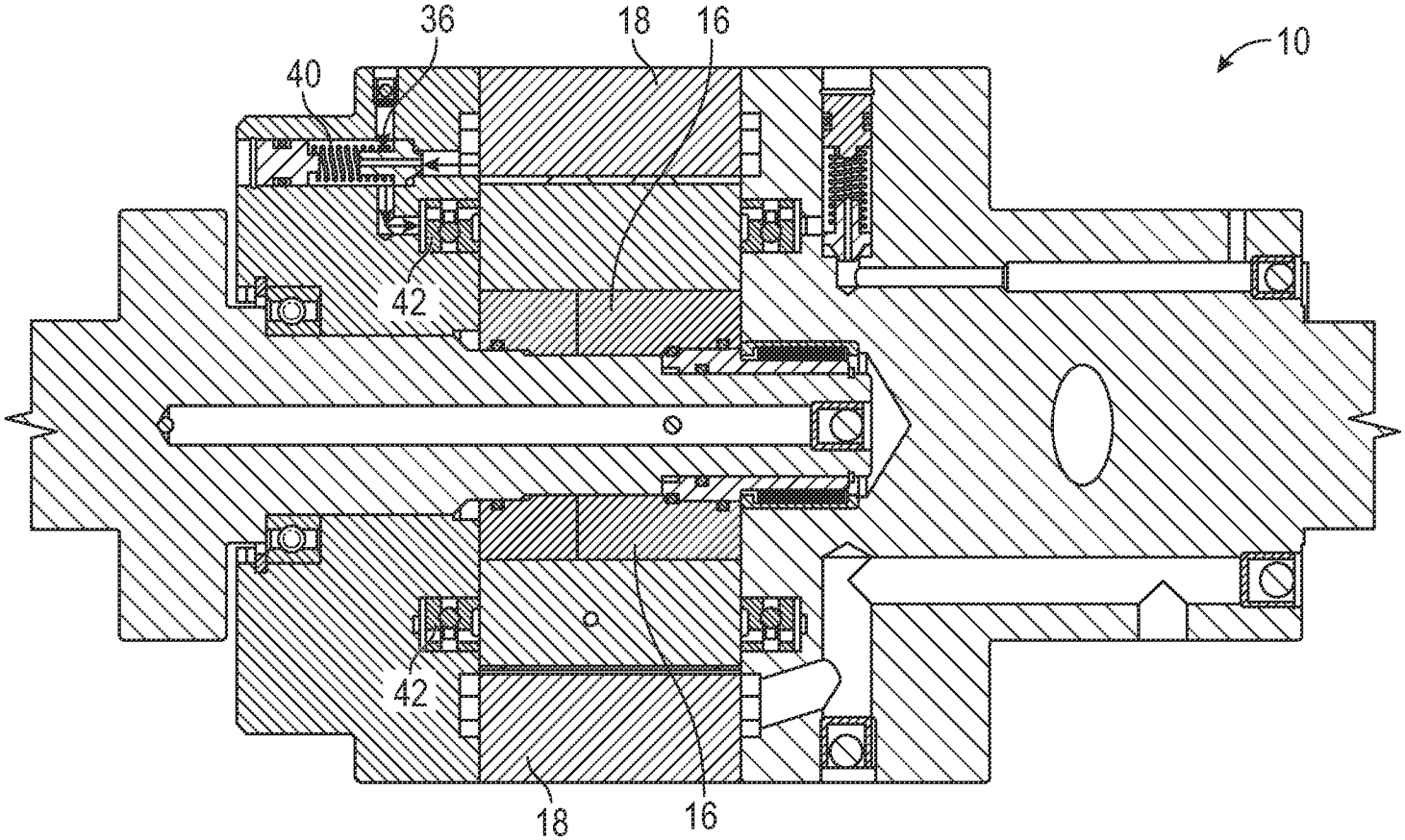
FIG. 2A is a cross-sectional view of a portion of the hydraulic device of FIG. 1B showing operation of the hydraulic device in a pump mode where hydraulic fluid is passed from a pressure quadrant to a vane step region according to an example of the present application.
Figure 2B:
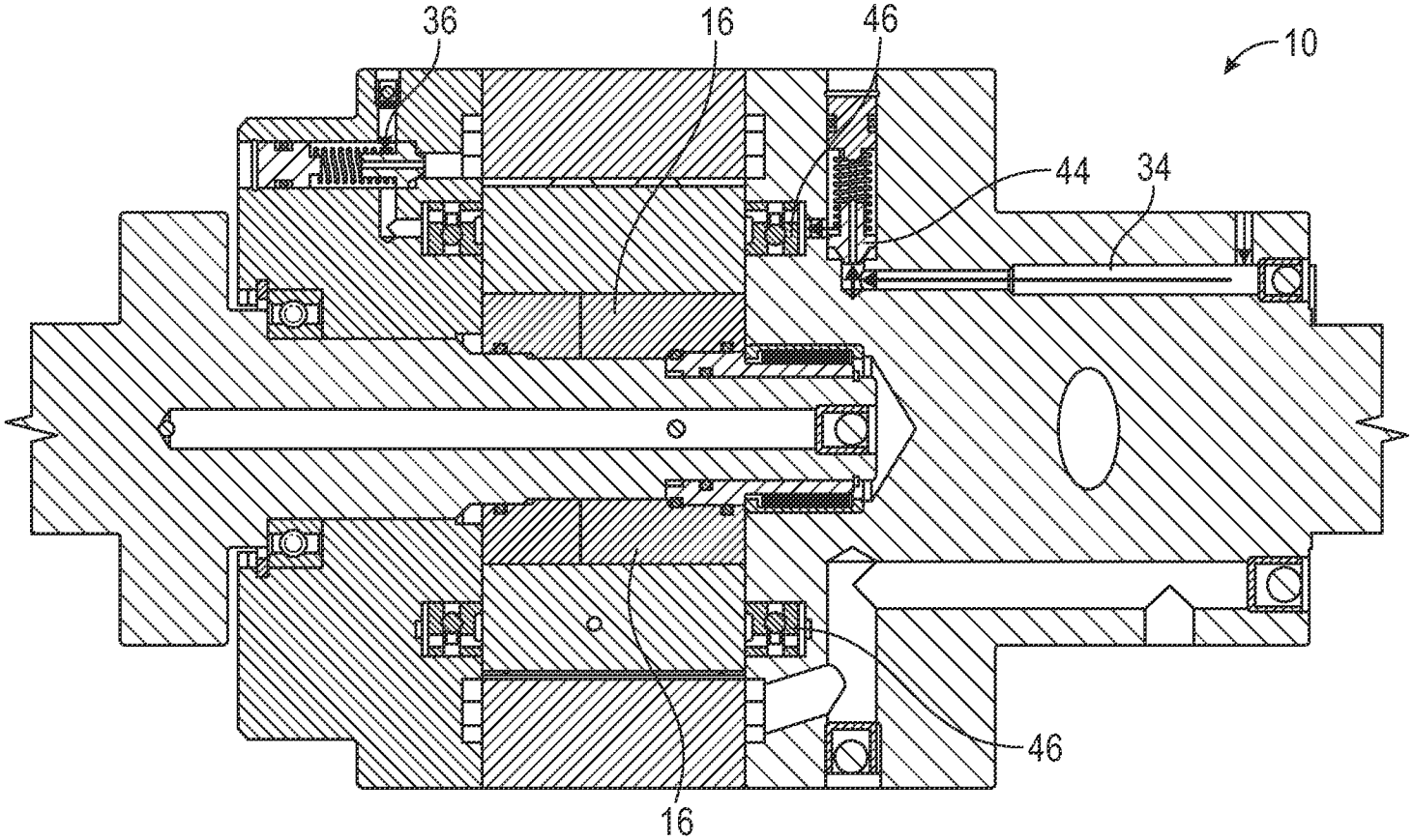
FIG. 2B is a cross-sectional view of a portion of the hydraulic device of FIG. 1B showing operation of the hydraulic device in a motor mode where pressurized hydraulic fluid is passed from an external port to a vane step region through a poppet valve according to an example of the present application.

FIGS. 2A and 2B illustrate hydraulic fluid and other component arrangement during pump mode (FIG. 2A) and motor mode (FIG. 2B) of operation of the hydraulic device 10. The housing has been removed in FIGS. 2A and 2B.

FIG. 2A shows the pump mode where hydraulic fluid passes from a pressure quadrant of the cavity (defined between the rotor 16 and the ring 18 and illustrated further subsequently) to a vane step region (again illustrated and discussed subsequently). Flow of the hydraulic fluid to the vane step region can cause the stepped vanes to extend and move relative to the rotor 16 as previously described. The hydraulic fluid flow is shown with arrows and passes across the one or more poppets 36. The one or more poppets 36 are pushed from the position shown away from the ring 18 and rotor 16 by the hydraulic flow from the pressure quadrant (i.e. the pressure of the hydraulic fluid overcomes the bias of the spring 40 on the one or more poppets 36. Hydraulic fluid can pass to the vane step via a first thrust bearing 42 (further illustrated subsequently) according to some examples. Upon retraction of the stepped vanes into the slot in the rotor 16 as previously described, the volume of the vane step region is decreased and the hydraulic fluid flows back through and/or across the one or more poppets 36 to be discharged. Such flow can be via a passage (not shown) with a diameter of just a less than a mm to a few mm.

FIG. 2B shows a motor mode of operation for the hydraulic device 10 such as the starter motor operation mode previously described. As indicated by arrows, hydraulic fluid from an external source (e.g., an accumulator, etc.) can be ported via passages 34 so as to move a second one or more poppets 44 (positioned in the passages 34) by overcoming a spring bias thereon. This allows for flow of the hydraulic fluid through or past a second thrust bearing 46 to the vane step region. Flow of the hydraulic fluid to the vane step region can cause the stepped vanes to extend and move relative to the rotor 16 as previously described. Note that in the motor mode of operation, the one or more poppets 36 (or another device) can be used to block hydraulic fluid flow from the pressure quadrant of the cavity (sometimes referred to as a chamber). Such was not the case during the pump mode of operation previously described in reference to FIG. 2A. In motor mode, upon retraction of the stepped vanes into the slot in the rotor 16 as previously described, the volume of the vane step region is decreased and the hydraulic fluid flows through and/or across the one or more poppets 36 to be discharged as previously described with respect to FIG. 2A.

Figure 3:
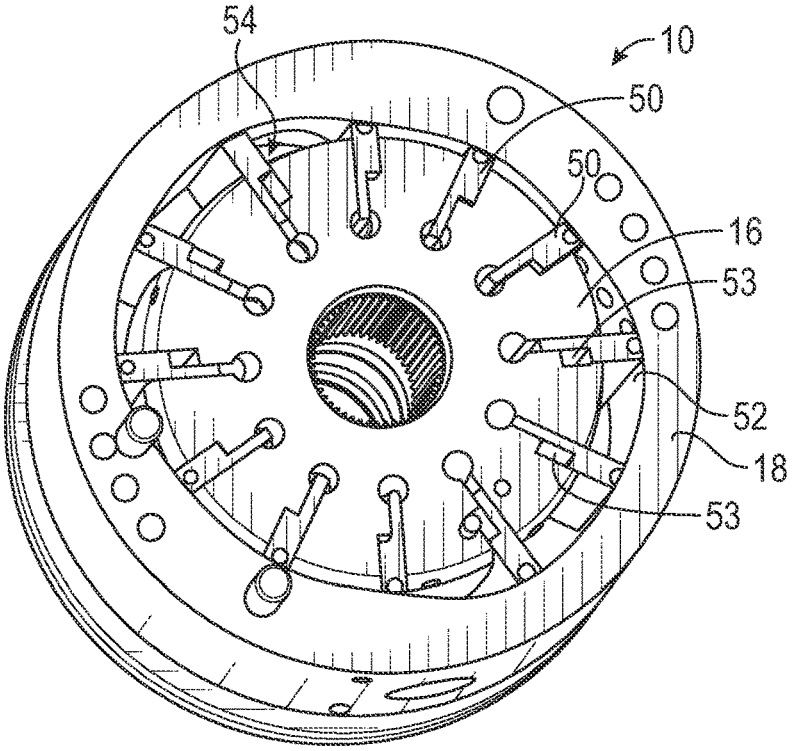
FIGS. 3 and 3A include a cross-sectional view of portions of the hydraulic device showing a rotor, ring and stepped roller vanes according to an example of the present application.
Figure 3A:
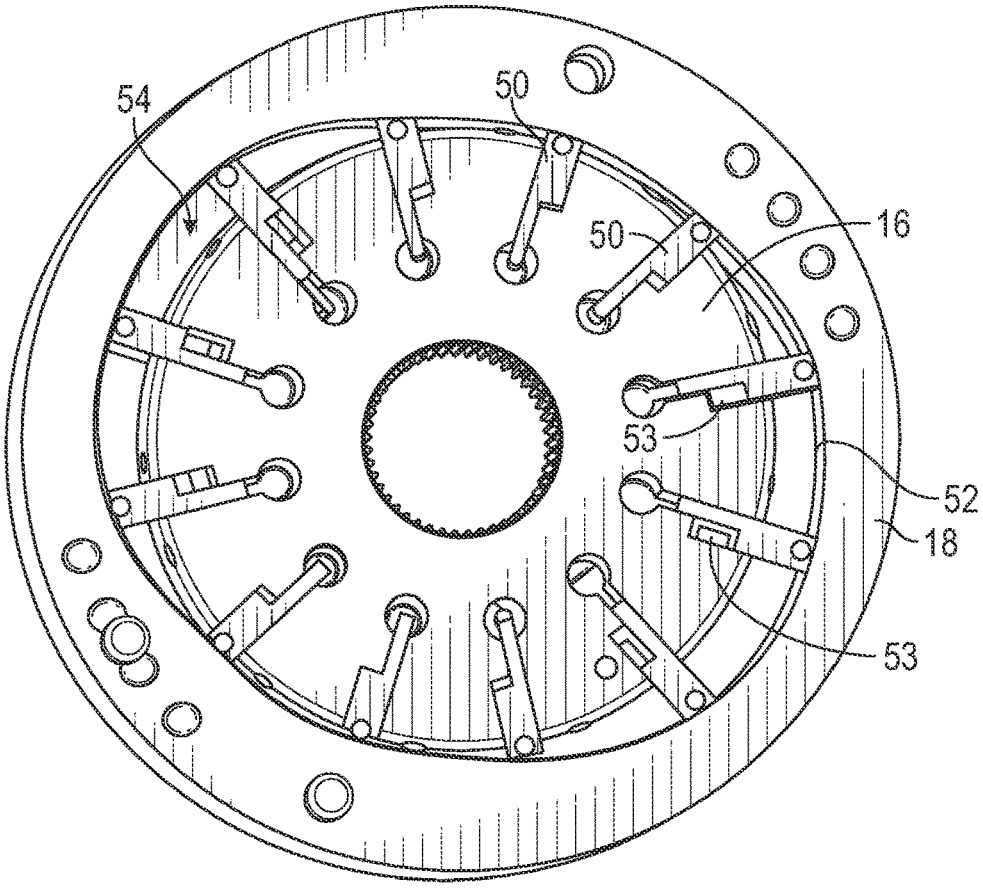

FIGS. 3 and 3A show the hydraulic device 10 with stepped vanes 50 as well as the disposition of the stepped vanes 50 relative to the rotor 16 and the ring 18. As illustrated in FIGS. 3 and 3A, the ring 18 can have a non-circular interior shape in cross-section while the rotor 16 can be circular in cross-section. Thus, the stepped vanes 50 can extend various distances relative to the rotor 16 to contact the inner surface 52 of the ring 18. FIGS. 3 and 3A also show the vane step region 53 which is present for each rotor 16 and stepped vane 50 combination. However, the size (volume) of the vane step region 53 will differ for each combination of the rotor 16 and the stepped vanes 50 due to the geometry of the ring 18 relative to the rotor 16 (non-circular interior shape in cross-section while the rotor 16 can be circular in cross-section).

As shown in FIGS. 3 and 3A, a cavity 54 can be defined between the rotor 16, the ring 18, the front plate 20, and the rear plate (not shown). The geometry of the cavity 54 can change with rotation of the rotor 16 and movement of the stepped vanes 50 (e.g. being extended and retracted from and into the rotor 16). As previously discussed, various ports (shown in FIGS. 4-6) are defined by the front plate 20, the rear plate 22 (not shown), the ring 18, the rotor 16 (including the plurality of vanes). As shown in FIGS. 3 and 3A, the cavity 54 can be configured to allow the hydraulic fluid to be disposed radially outward of at least a portion of the rotor 16 when the plurality of stepped vanes 50 transition these ports. In the example of FIGS. 3 and 3A, the cavity 54 can extend axially along and can be defined by an inner surface of the ring 18 as well as being defined by the rotor 16.

Figure 4:
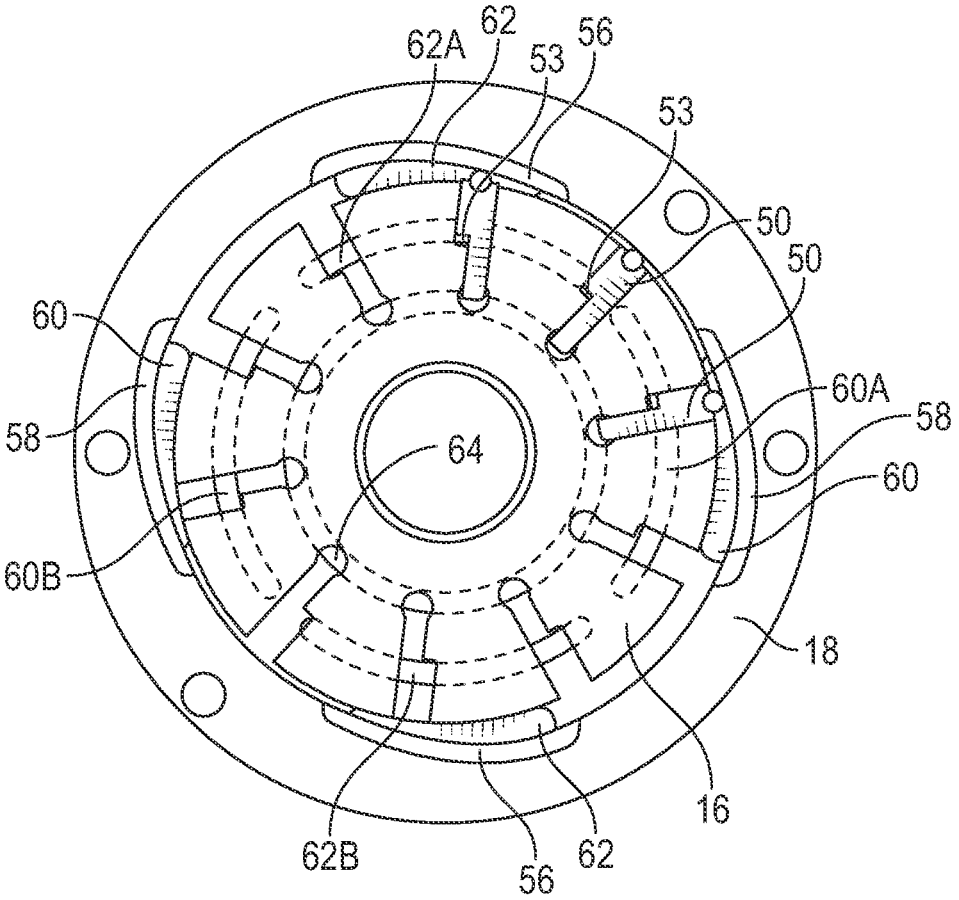
FIGS. 4-6 show a portion of the hydraulic device of FIGS. 3 and 3A with a number of the stepped roller vanes removed and showing internal passages within the rotor for passage of hydraulic fluid to control movement of the roller vanes through various modes of operation including a suction mode, a dwell mode and a pressure mode of operation as exemplified by three roller vanes according to an example of the present application.
Figure 5:
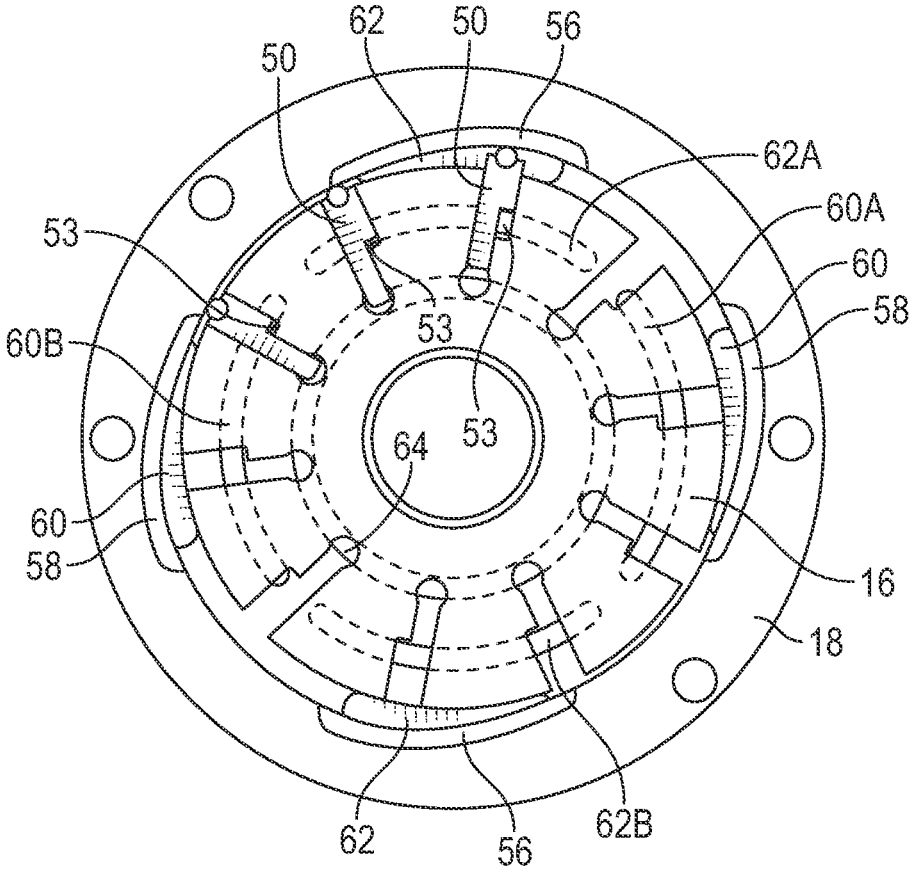
Figure 6:
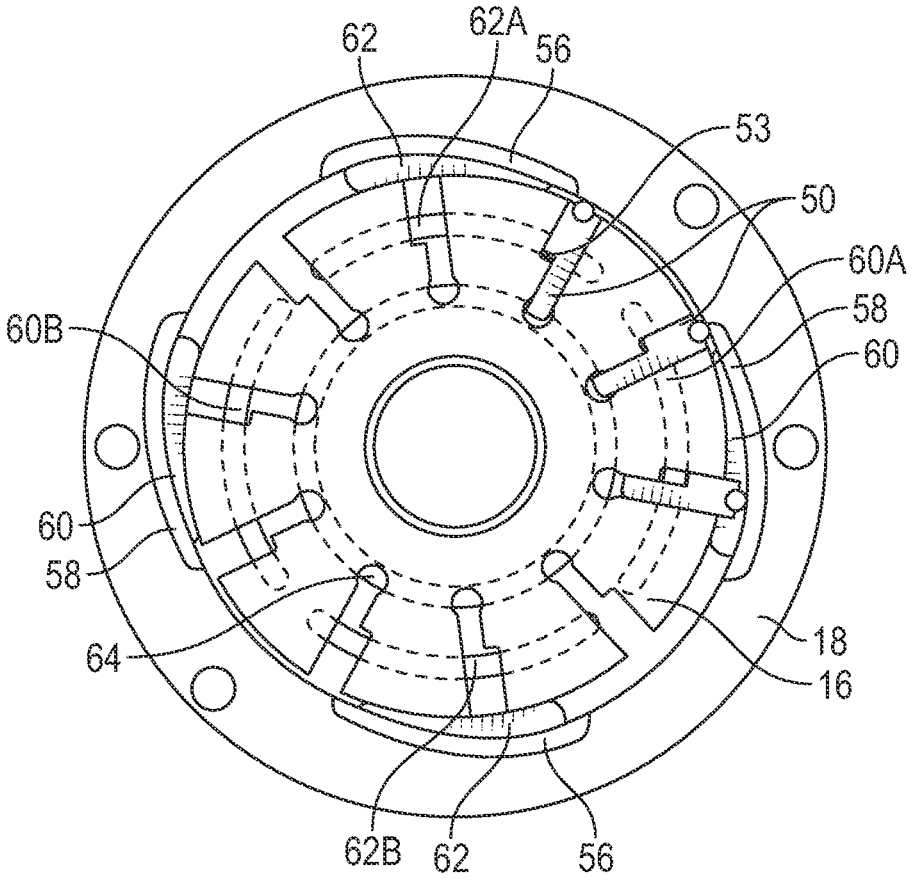

FIGS. 4-6 show some of the stepped vanes 50 as well as the rotor 16 and the ring 18, FIGS. 4, 5 and 6 further show suction ports 56 and outlet ports 58 (discussed above). These ports allow communication of hydraulic fluid to or from the cavity 54 as operational criteria dictate. Within the cavity 54 the hydraulic fluid can be worked by the stepped vanes 50 as previously discussed.

FIGS. 4-6 further show pressure regions 60 and suction regions 62. These regions 60, 62 can additionally be undervane regions 60A, 60B and 62A, 62B (i.e. passing through the front or rear plate and/or rotor 16) that selectively communicate with the vane step region 53 as the rotor 16 rotates. Such undervane regions 60A, 60B and 62A, 62, and/or 64 can comprise ports with pressure similar to those or differing from those of suction ports 56 and outlet ports 58. An outlet pressure can be maintained on an undervane region 64 for full rotation of the rotor 16 to maintain a constant outward force on the stepped vanes 50. This force on the stepped vanes 50 can additionally be varied by use of the undervane regions 60A, 60B and 62A, 62B as will be discussed subsequently.

FIG. 4 shows that when at least two of stepped vanes 50 are undergoing suction process (i.e. are in suction regions 62 and 62A) the undervane region 64 can be open to outlet pressure and the stepped vane areas 53 are open to suction pressure. The stepped vane areas 53 are open to suction via ports that communicate with the regions 62, 62A and 62B (only port 56 is identified). During the suction process, dwell process, and pressure process the outer radial portion of each of the stepped vanes (in the area of port 56) can operate as a standard vane pump as shown in FIGS. 4-6.

Figure 4A:
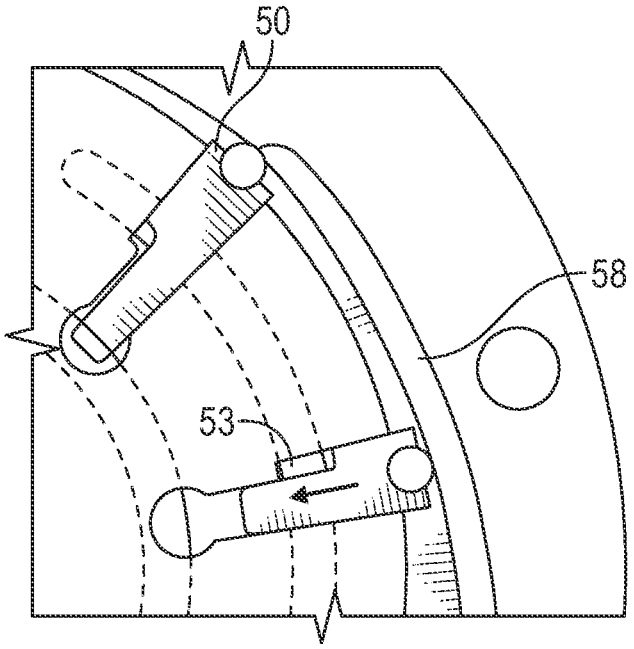

FIG. 4A shows an enlargement of a portion of the outer radial portion of the stepped vanes 50 adjacent the outlet port 58. As each of the stepped vanes 50 comprise roller vanes without leading edges on the vane, the vanes are fitted to the vane body. In the area of the outlet port 58 the vane is subject to a high pressure wedge force (indicated by arrow). To counter this force the working area of a corresponding outward force (exerted by hydraulic fluid communicated through the undervane region to the stepped vane area 53) must exceed the wedge force. Thus, the stepped vane areas 53 can act as a pumping chamber. As the stepped vane 50 retracts hydraulic fluid can be pumped to pressure (e.g. via the outlet port 58 and/or other ports), and when the stepped vane 50 extends the stepped vane area 53 can be filled with hydraulic fluid in suction (e.g., via the suction port 56 and/or other ports).

FIG. 5 shows that when at least two of stepped vanes 50 are undergoing a dwell (the stepped vane areas 53 can be in regions 62A and 60B, respectively) the undervane region 64 can be open to outlet pressure and the stepped vane areas 53 can be closed.

FIG. 6 shows that when at least two of stepped vanes 50 are undergoing pressure process (i.e. are in pressure regions 60 and 60A) the undervane region 64 can be open to outlet pressure and the stepped vane areas 53 are open to outlet pressure as well. The stepped vane areas 53 can be open to outlet pressure via ports that communicate with the regions 60, 60A and 60B (only port 58 is identified in FIG. 6).

Figure 7:
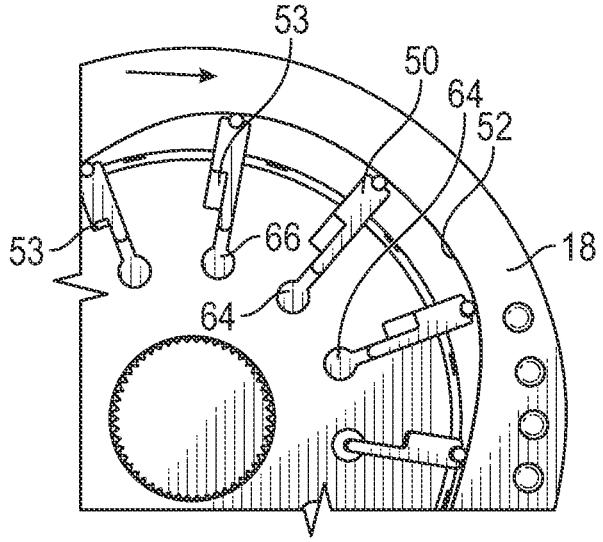
FIG. 7 additionally shows a portion of the hydraulic device of FIGS. 3 and 3A with the stepped roller vanes having movement controlled relative to the ring by the hydraulic fluid disposed undervane according to an example of the present application.

FIG. 7 shows the processes (pressure and suction) described in reference to FIGS. 4-6 where hydraulic fluid 66 is ported to or from the stepped vane areas 53 to provide a desired outward force on the respective stepped vanes 50 such that the rollers of such vanes remain in contact the inner surface 52 of the ring 18 with an appropriate amount of force between each roller and the inner surface 52 being applied. As shown in FIG. 7, the volume of the hydraulic fluid 66 in the stepped vane areas 53 will change with rotation of the rotor 16 relative to the ring 18. As shown in FIG. 7, the intervane regions 64 are always supplied with hydraulic fluid 66.

Figure 8A:
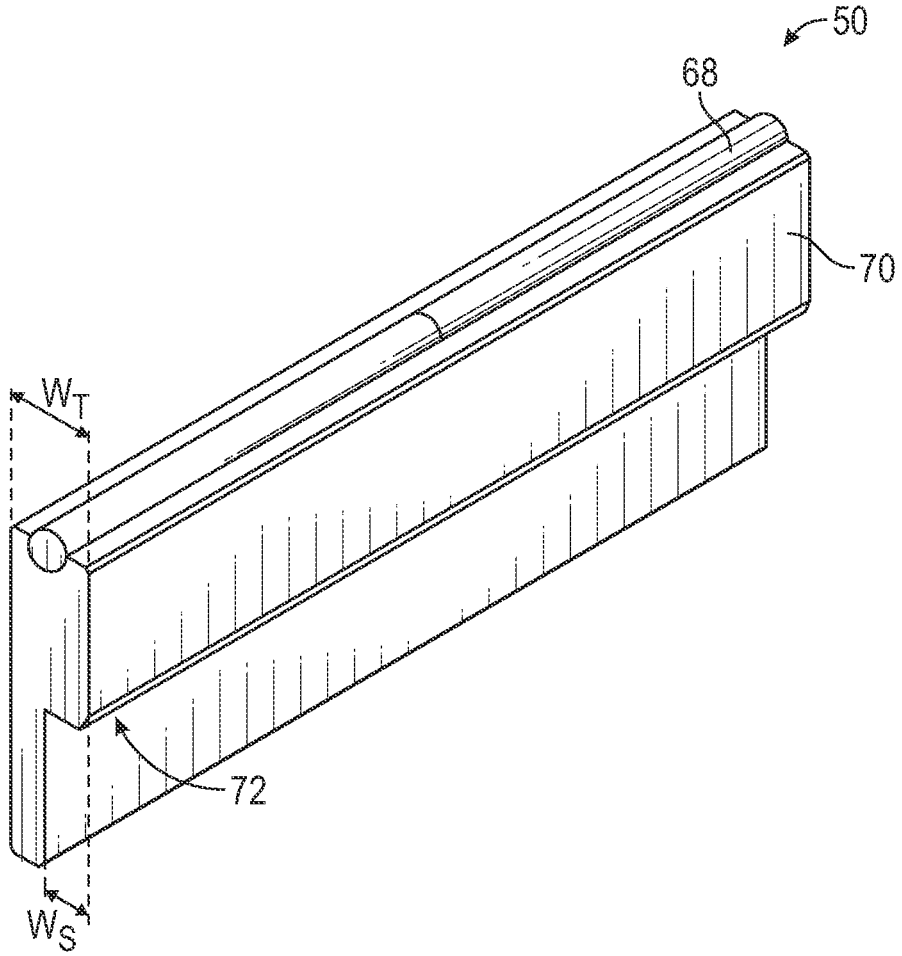
FIG. 8A shows a first perspective view a stepped roller vane including the stepped vane and roller according to an example of the present application.
Figure 8B:
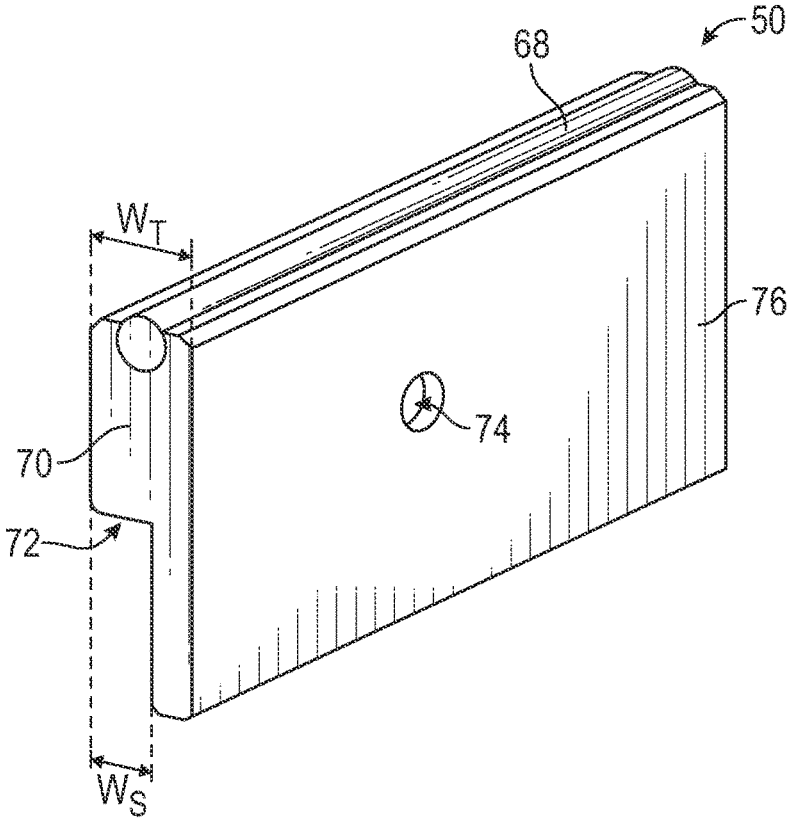
FIG. 8B shows a second perspective view the stepped roller vane with a decent in a portion thereof according to an example of the present application.
Figure 9:
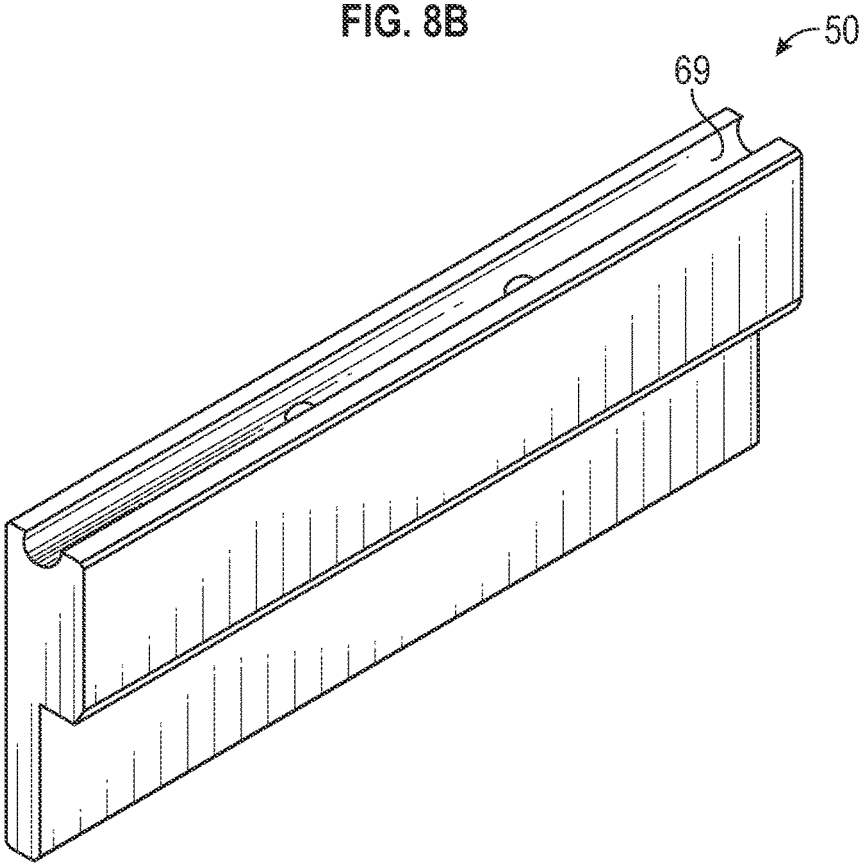
FIG. 9 shows the stepped roller vane of FIG. 8A with the roller removed according to an example of the present application.

FIGS. 8A and 8B show the stepped vane 50 and roller 68 according to one embodiment. FIG. 9 shows the stepped vane 50 with the roller removed to show a roller cavity 69. Each stepped vane 50 has a body 70 configured to form a step 72. The step 72 can have a width WS of substantially 55% of a total vane width WT according to some embodiments. This means that if total vane width WT is 4.8 mm the step 72 width WS would be 2.64 mm. However, according to other embodiments the width WS can be between 45% and 65% of the total vane width WT. As discussed previously, roller vane design requires an increased outward force on the vane to compensate for the dynamic inward force of the roller passing through the hydraulic fluid in suction and outlet pressure regions. The present stepped vane design allows a larger surface area of about 55% of the total vane width WT for pressurized hydraulic fluid to create outward radial force on the stepped vane 50 so as to maintain contact of the roller 68 with the inner surface of the ring.

FIG. 8B shows a detent 74 that can be used on a rear face 76 of the body 70. The detent 74 can be used in combination with a locking mechanism (described and illustrated in reference to FIG. 13) to retain the stepped vane within the rotor should operational criteria dictate.

Figure 10:
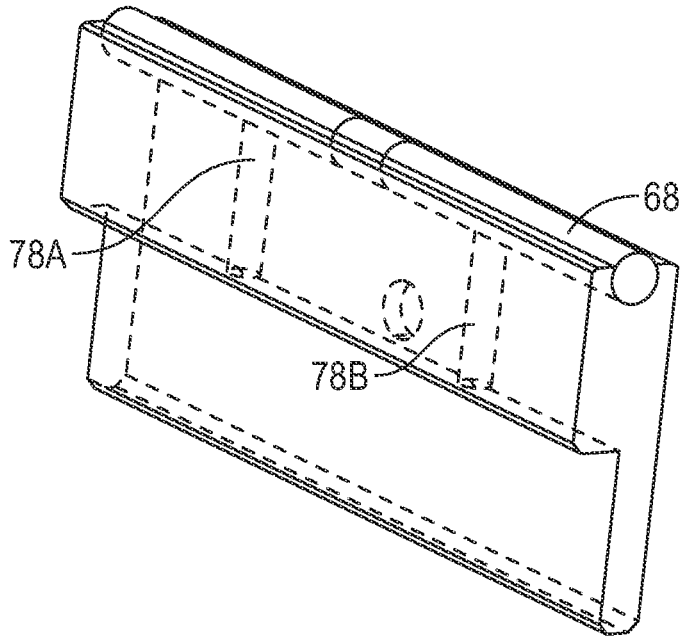
FIG. 10 shows a stepped roller vane with the stepped vane in phantom to illustrate internal passages for lubricant flow to the roller according to an example of the present application.
Figure 11:
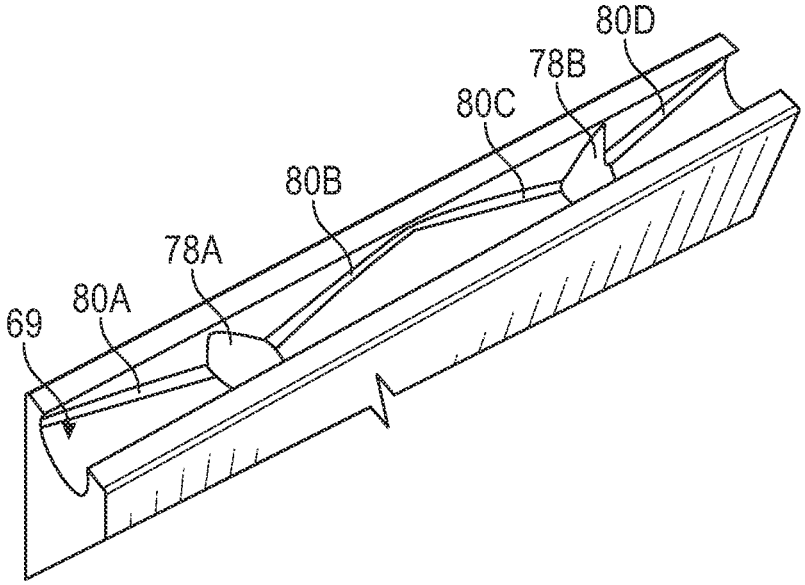
FIG. 11 shows a roller cavity of the stepped vane having grooves therealong for lubricant flow about the roller according to an example of the present application.

FIGS. 10 and 11 show internal passages 78A, 78B and grooves 80A, 80B, 80C and 80D that can communicate hydraulic fluid to the roller 68 (not shown in FIG. 11) to be used as lubricant. The hydraulic fluid creates a lubricating film on the roller 68, which can be configured to rotate within the roller cavity 69 (FIG. 11) according to some embodiments.

Figure 12:
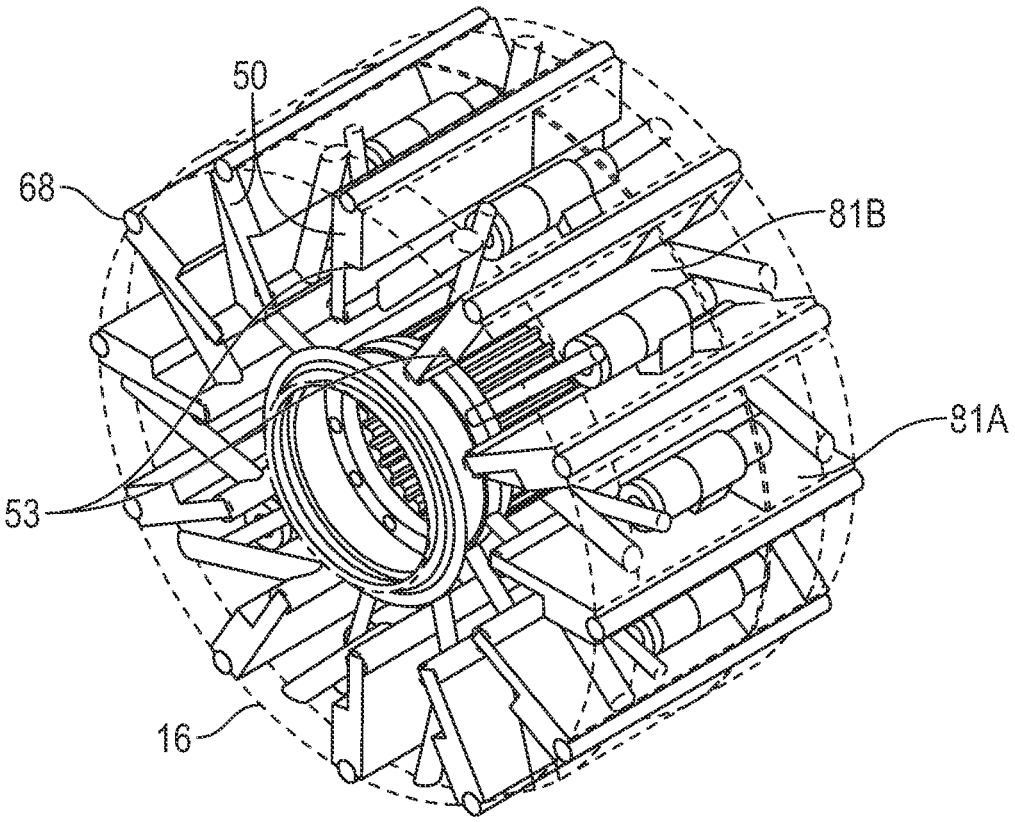
FIG. 12 is a perspective view of a portion of the hydraulic device showing the rotor, stepped vanes without the ring, portions of the rotor are shown in phantom to illustrate internal passages for hydraulic fluid flow, additionally the rotor can be split into portions according to an example of the present application.

FIG. 12 shows the stepped vanes 50 disposed within the rotor 16 of the hydraulic device 10. FIG. 12 also shows internal passages within the rotor 16 that can be used for hydraulic fluid flow such as to the vane step region 53 as previously described. FIG. 12 additionally shows that the rotor 16 can be segmented into two or more portions 81A and 81B according to some embodiments. Similarly, the stepped vanes 50 and/or roller 68 can be segmented so as to form portions according to some embodiments.

Figure 13:
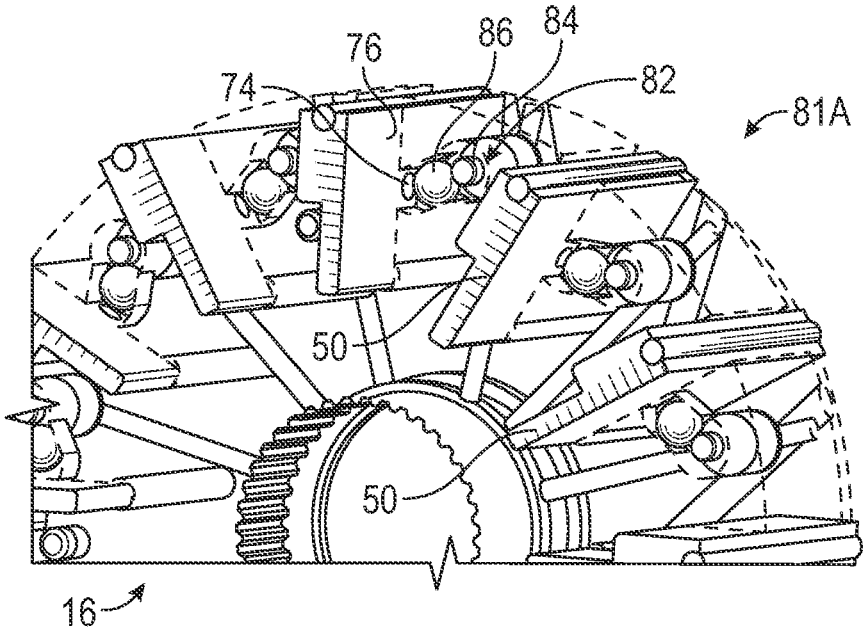
FIG. 13 is an enlarged view of a portion of the rotor of FIG. 12 showing an actuator mechanism and a ball that can be used to lock the stepped roller vanes in a retracted position according to an example of the present application.

FIG. 13 shows portion 81A of the rotor 16 and the stepped vanes 50 from FIG. 12 with additional portions removed. FIG. 13 additionally shows a locking mechanism 82 that comprises an actuator 84 and a ball 86. The ball 86 can be moveable by the actuator 84 to engage with the detent 74 on the rear face 76 of the stepped vane 50 to retain the stepped vane 50 within the rotor 16 as shown in FIG. 13. According to one example, a hydraulic pilot signal can be sent to the actuator 84 (e.g. a tapered push pin), which in turn forces the ball 86 into the detent 74. This prevents the stepped vane 50 from following the contour of the inner surface of the ring and creating pumping chambers. The locked/retained position shown (with the stepped vane 50 retracted into the rotor 16 can effectively be considered a neutral position with very low parasitic losses and zero flow.

Figure 14:
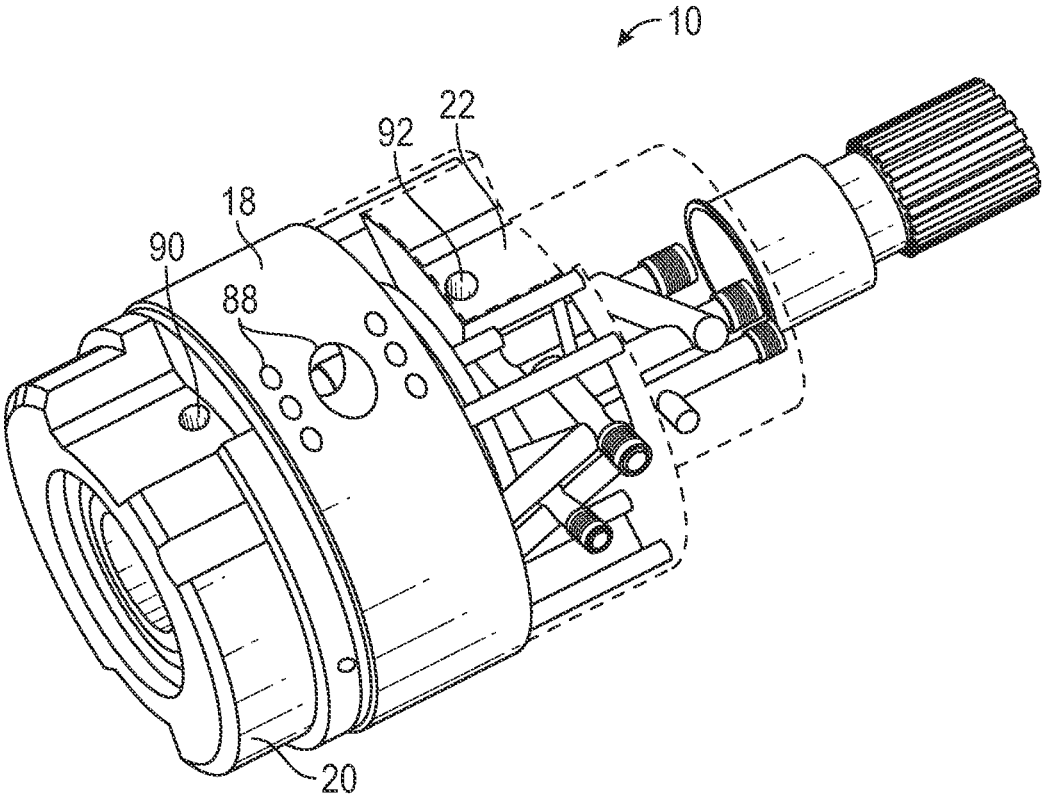
FIG. 14 shows the hydraulic device with portions of a housing and other components removed to show an output shaft and an assembled cartridge including a front plate and the ring according to an example of the present application.

FIG. 14 shows the hydraulic device 10 without the housing and the input shaft as previously illustrated. Suction ports 88 on the ring 18 are shown as is a suction port 90 to the front plate 20 in FIG. 14. The rear plate 22 is also shown having a suction port 92. FIG. 14 shows various other ports that can be used for hydrostat, hydraulic fluid outflow for power split and for other purposes. According to one example, the hydraulic device 10 can be configured as a power split transmission, a pump, a motor, a starter motor and can be used for hydraulic hybrid power regeneration according to various modes of operation as previously discussed. For a pump mode of operation, the output shaft can be effectively neutralized and the ring 18 can be held stationary in the housing.

Figure 15:
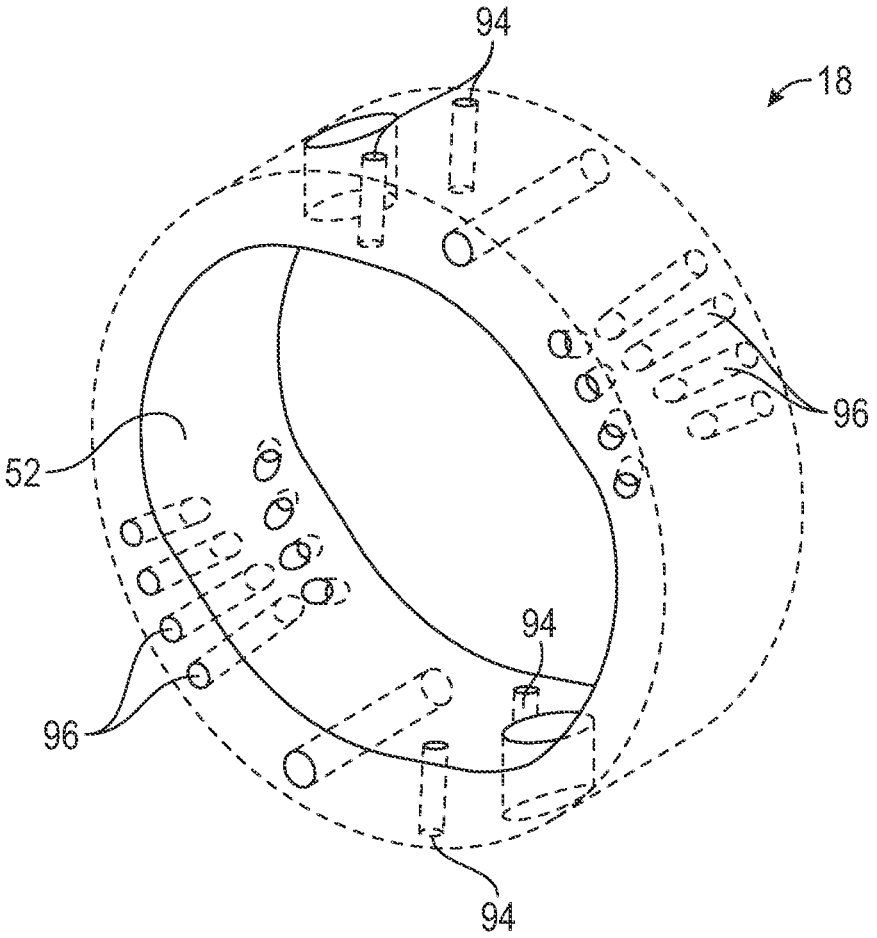
FIGS. 15 and 16A-16B show the ring including in phantom in FIG. 15 to illustrate internal passages that facilitate hydraulic fluid flow according to an example of the present application.
Figure 16A:
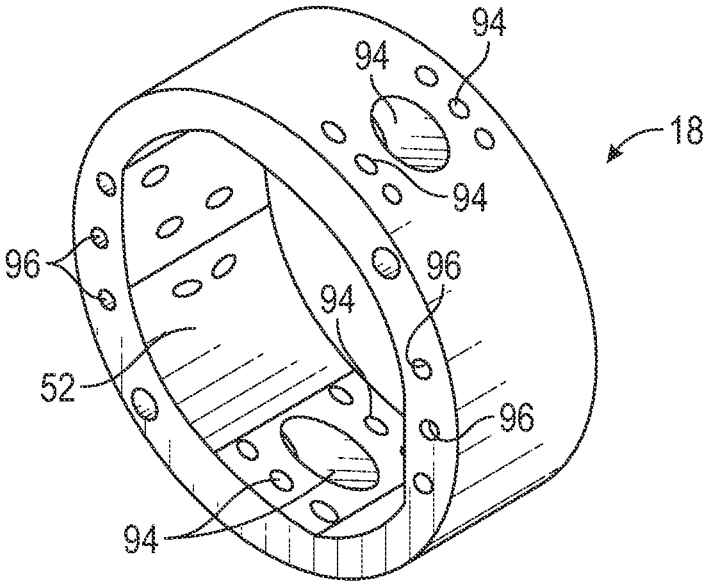
Figure 16B:
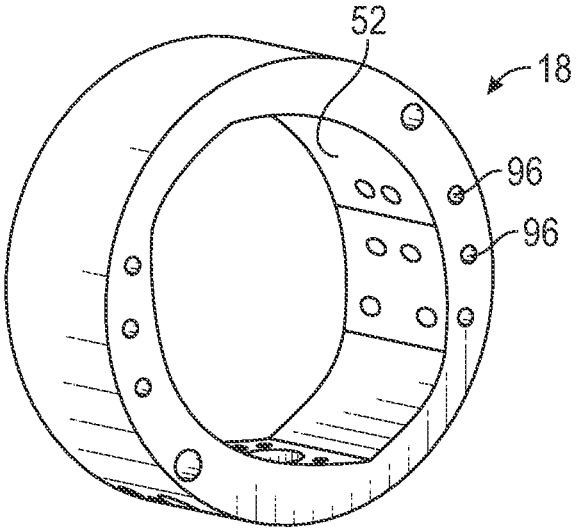

FIGS. 15-16B show the ring 18 in further detail including the inner surface 52, suction ports and channels 94, and pressure outlets and channels 96. The exact number and size of such suction ports and channels 94 and pressure outlets and channels 96 can vary depending upon operational criteria and other factors.

Figure 17:
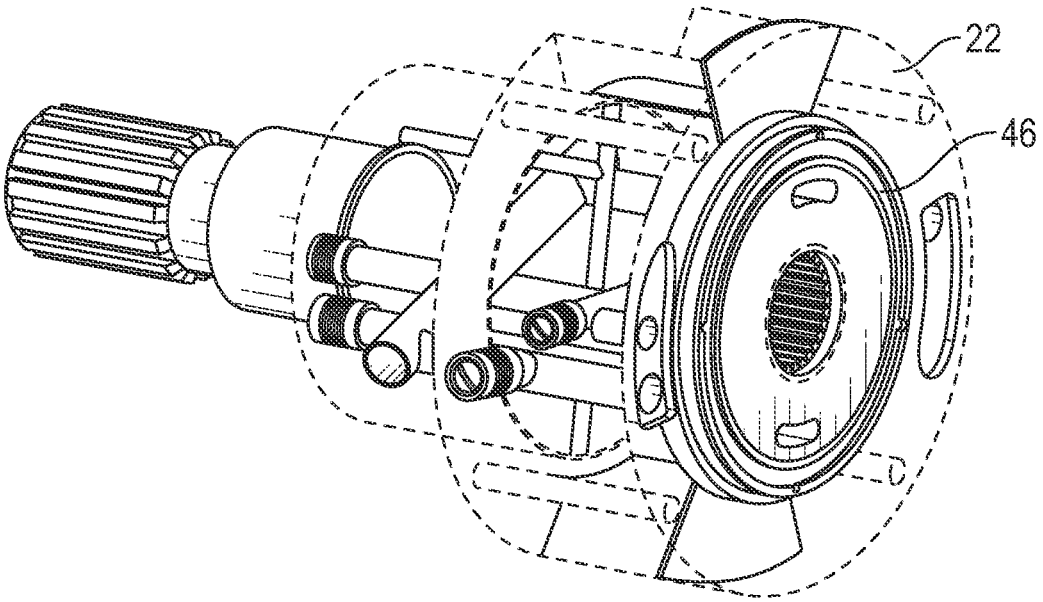
FIG. 17 shows the hydraulic device with portions of the housing and other components removed to show a thrust bearing disposed as part of the output shaft assembly according to an example of the present application.
Figure 18A:
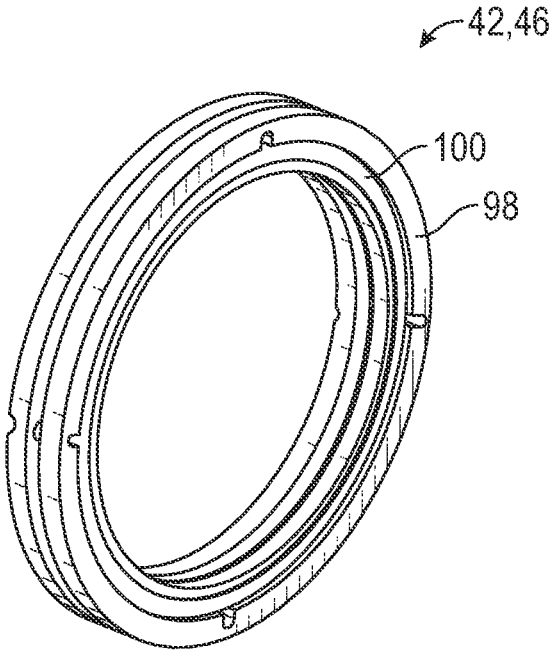
FIGS. 18A and 18B show perspective views of the thrust bearing according to an example of the present application.
Figure 18B:
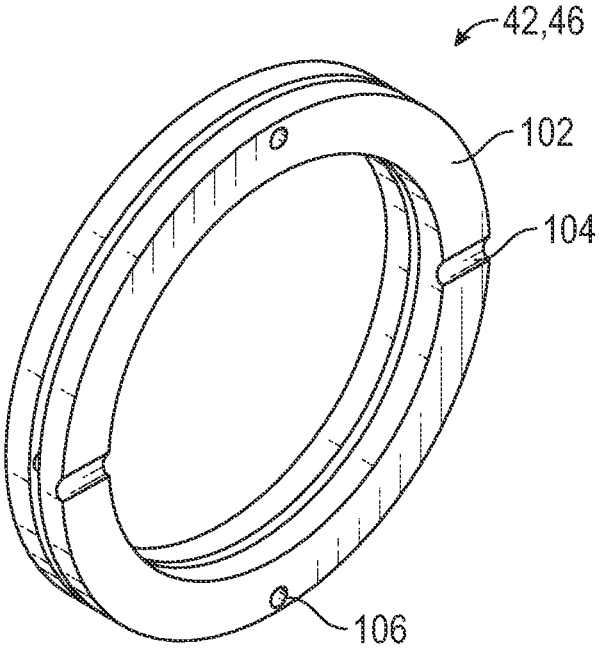

FIGS. 17-18B show one of the first thrust bearings 42 or the second thrust bearings 46 as previously described. FIG. 17 shows the second thrust bearings 46 mounted within the rear plate 22. FIGS. 18A and 18B show the construct of either the first thrust bearings 42 or the second thrust bearings 46 from different perspectives.

The thrust bearing design can allow for very close tolerances from rotor to the front and back plates 20, 22 (20 not shown in FIG. 17). Such close tolerance can reduce leakage and reduce instances of rubbing motion between components. It also allows the pressure hydraulic fluid feed to the vane step region as previously described to provide the outward radial force to maintain roller contact with the ring.

FIG. 18A shows the portion of the thrust bearing 42, 46 that interfaces with the rotor 16 (not shown). This face 98 can have an annular groove 100 therein that allows for passage of hydraulic fluid to the vane step region. FIG. 18B shows an opposing face 102 of the thrust bearing 42, 46 that can face the plate 20 or 22. The face 102 can include slots 104 that allow for passage of oil to the annular groove. Other features such as one or more bearing pin holes 106 are also provided.

Figure 19A:
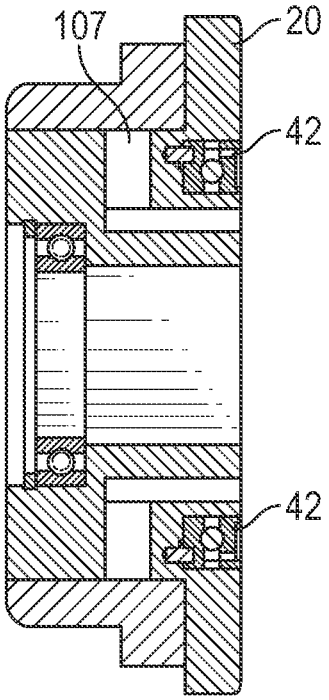
FIGS. 19A and 19B show cross-sections of the thrust bearing and a front pressure plate according to an example of the present application.
Figure 19B:
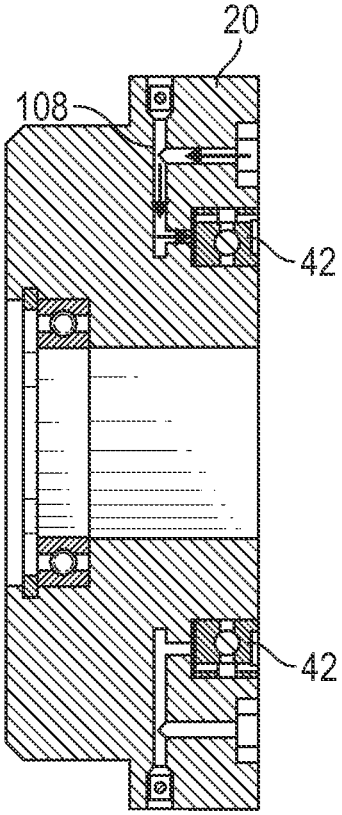

FIGS. 19A and 19B show the first thrust bearing 42 disposed within the front plate 20 and carried thereby. FIGS. 19A and 19B also show the front plate 20 in further detail through two separate cross-sections. The front plate 20 can include ports and passages as previously described including a passage 107 configured for hydraulic fluid to flow in suction to a bottom of the stepped vane as shown in FIG. 19A. FIG. 19B shows the front plate 20 can have a second passage 108 for flow of hydraulic fluid from the pressure region (described and illustrated previously) to the vane step region. Such second passage 108 can be to the thrust bearing 42 which allows the hydraulic fluid to pass through and past the thrust bearing 42 to the vane step region according to some embodiments.

Figure 20:
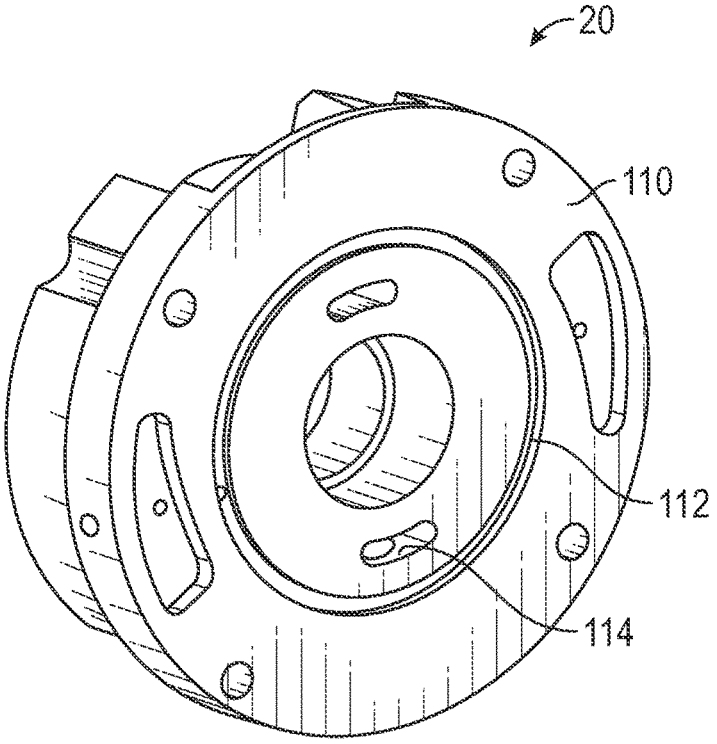
FIG. 20 show a perspective view of the front pressure plate according to an example of the present application.

FIG. 20 shows an example of the front plate 20 without the thrust bearing 42 (FIGS. 19A and 19B) fitted thereto. FIG. 20 shows pressure feed holes and grooves used for stepped vane operation as previously described. In particular, the front plate 20 can have a face 110. The face 110 can be contoured in the area of the outlet cavity 112 to prevent rollers from sliding from the vane body. The face 110 can include grooves 112 for facilitating flow of hydraulic fluid to the vane step region as previously described and illustrated. Additionally, one or more passages 114 can be provided in the front plate 20 to facilitate hydraulic fluid flow to the intervane region 64 as previously described and illustrated. Although not shown in FIG. 20, rear plate 22 can have a construction similar to that of the front plate 20 and can include features such as the grooves 112 and one or more passages 114.

The disclosed hydraulic devices can allow for benefits such as reducing peak transient forces experienced by the powertrain, reduced hydraulic noise, greater fuel efficiency, reduced emissions, among other benefits.

Other examples not specifically discussed herein with reference to the FIGURES can be utilized. The disclosed devices are applicable to various types of vehicles such as earth moving equipment (e.g., wheel loaders, mini-loaders, backhoes, dump trucks, crane trucks, transit mixers, etc.), waste recovery vehicles, marine vehicles, industrial equipment (e.g., agricultural equipment), personal vehicles, public transportation vehicles, and commercial road vehicles (e.g., heavy road trucks, semi-trucks, etc.). The hydraulic devices disclosed can also be used in other applications where the device would be stationary (e.g., in wind power harvesting and production and/or other types of energy harvesting and production).

Although specific configurations of devices are shown in FIGS. 1-20 and particularly described above, other designs that fall within the scope of the claims are anticipated.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein," Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

To further illustrate the systems and/or apparatuses disclosed herein, the following non-limiting examples are provided:

In Example 1, a hydraulic device that can optionally include: a rotor disposed for rotation about an axis; a plurality of vanes each including a vane step, each of the plurality of vanes moveable relative to the rotor between a retracted position and an extended position where the plurality of vanes work a hydraulic fluid introduced adjacent the rotor; a roller mounted to a tip of each of the plurality of vanes; and a ring disposed at least partially around the rotor, the rotor including one or more passages for ingress or egress of a hydraulic fluid to or from a region adjacent the vane step and defined by at least the rotor and the vane step.

In Example 2, the hydraulic device of Example 1, can further optionally include: a first thrust bearing disposed adjacent a first axial end of the rotor; and a second thrust bearing disposed adjacent a second axial end of the rotor, the second axial end opposing the first axial end; wherein the hydraulic fluid passes across at least one of the first thrust bearing and the second trust bearing to communicate with the one or more passages in the rotor.

In Example 3, the hydraulic device of Example 2, can further optionally include: a first plate disposed adjacent the first axial end of the rotor and configured to at least partially house the first thrust bearing, the first plate defining having at least a first passageway configured to communicate the hydraulic fluid between the ring and the first thrust bearing; and a second plate disposed adjacent the second axial end of the rotor and configured to at least partially house the second thrust bearing, the second plate defining at least a second passageway configured to communicate the hydraulic fluid to the second thrust bearing.

In Example 4, the hydraulic device of Example 3, can further optionally include at least one poppet valve disposed within one or both of the first plate and the second plate to regulate a flow of the hydraulic fluid.

In Example 5, the hydraulic device of Example 3, wherein one or more of the first plate, the second plate and the rotor can optionally define an undervane region, the undervane region configured to supply the hydraulic fluid to an inner radial portion of each of the plurality of vanes.

In Example 6, the hydraulic device of one or any combination of Examples 1-5, wherein at least one of the plurality of vanes can optionally include a passage extending from the vane step to the tip beneath the roller.

In Example 7, the hydraulic device of Example 6, wherein the roller can optionally be configured to rotate relative to the vane on a film of the hydraulic fluid.

In Example 8, the hydraulic device of any one or any combination of Examples 1-7, wherein a width of the vane step can optionally comprise between 45% and 65% of a total width of each of the plurality of vanes.

In Example 9, the hydraulic device of Example 8, wherein the width of the vane step can optionally comprise substantially 55% of the total width.

In Example 10, A system can optionally include: a hydraulic device, the hydraulic device optionally comprising: a rotor disposed for rotation about an axis; a plurality of vanes each including a vane step, each of the plurality of vanes moveable relative to the rotor between a retracted position and an extended position where the plurality of vanes work a hydraulic fluid introduced adjacent the rotor; a roller mounted to a tip of each of the plurality of vanes; and a ring disposed at least partially around the rotor, the rotor including one or more passages for ingress or egress of a hydraulic fluid to or from a region adjacent the vane step and defined by at least the rotor and the vane step; and an accumulator in fluid communication with the hydraulic device to supply the hydraulic fluid thereto, the hydraulic fluid extending one or more of the plurality of vane out of the rotor and against the ring such that the hydraulic device is operable as a starter motor.

In Example 11, the system of Example 10, wherein the hydraulic device can further optionally include: a first thrust bearing disposed adjacent a first axial end of the rotor; and a second thrust bearing disposed adjacent a second axial end of the rotor, the second axial end opposing the first axial end; wherein the hydraulic fluid passes across at least one of the first thrust bearing and the second trust bearing to communicate with the one or more passages in the rotor.

In Example 12, the system of Example 11, wherein the hydraulic device further optionally includes: a first plate disposed adjacent the first axial end of the rotor and configured to at least partially house the first thrust bearing, the first plate defining having at least a first passageway configured to communicate the hydraulic fluid between the ring and the first thrust bearing; and a second plate disposed adjacent the second axial end of the rotor and configured to at least partially house the second thrust bearing, the second plate defining at least a second passageway configured to communicate the hydraulic fluid to the second thrust bearing.

In Example 13, the system of Example 12, wherein the hydraulic device further optionally includes at least one poppet valve disposed within one or both of the first plate and the second plate to regulate a flow of the hydraulic fluid.

In Example 13, the system of Example 12, wherein one or more of the first plate, the second plate and the rotor can optionally define an undervane region, the undervane region configured to supply the hydraulic fluid to an inner radial portion of each of the plurality of vanes.

In Example 14, the system of one or any combination of Examples 10-14, wherein at least one of the plurality of vanes includes a passage extending from the vane step to the tip beneath the roller.

In Example 16, the system of Example 15, wherein the roller can optionally be configured to rotate relative to the vane on a film of the hydraulic fluid.

In Example 17, the system of any one or any combination of Examples 10-16, wherein a width of the vane step can optionally comprise between 45% and 65% of a total width of each of the plurality of vanes.

In Example 18, the system of claim 17, wherein the width of the vane step can optionally comprise substantially 55% of the total width.

In Example 19, a hydraulic device can optionally include: a rotor disposed for rotation about an axis; a plurality of vanes each including a vane step, each of the plurality of vanes moveable relative to the rotor between a retracted position and an extended position where the plurality of vanes work a hydraulic fluid introduced adjacent the rotor; a roller mounted to a tip of each of the plurality of vanes; and a ring disposed at least partially around the rotor, the rotor including one or more passages for ingress or egress of a hydraulic fluid to or from a region adjacent the vane step and defined by at least the rotor and the vane step; a first thrust bearing disposed adjacent a first axial end of the rotor; and a second thrust bearing disposed adjacent a second axial end of the rotor, the second axial end opposing the first axial end; wherein the hydraulic fluid passes across at least one of the first thrust bearing and the second trust bearing to communicate with the one or more passages in the rotor.

In Example 20, the hydraulic device of Example 19, can further include: a first plate disposed adjacent the first axial end of the rotor and configured to at least partially house the first thrust bearing, the first plate defining having at least a first passageway configured to communicate the hydraulic fluid between the ring and the first thrust bearing; and a second plate disposed adjacent the second axial end of the rotor and configured to at least partially house the second thrust bearing, the second plate defining at least a second passageway configured to communicate the hydraulic fluid to the second thrust bearing.

In Example 21, the hydraulic device of Example 20, further comprising at least one poppet valve disposed within one or both of the first plate and the second plate to regulate a flow of the hydraulic fluid.

In Example 22, the hydraulic device of Example 20, wherein one or more of the first plate, the second plate and the rotor can optionally define an undervane region, the undervane region configured to supply the hydraulic fluid to an inner radial portion of each of the plurality of vanes.

In Example 23, the hydraulic device of one or any combination of Examples 19-22, wherein at least one of the plurality of vanes can optionally include a passage extending from the vane step to the tip beneath the roller.

In Example 24, the hydraulic device of Example 23, wherein the roller can optionally be configured to rotate relative to the vane on a film of the hydraulic fluid.

In Example 25, the hydraulic device of any one or any combination of Examples 19-24, wherein a width of the vane step can optionally comprise between 45% and 65% of a total width of each of the plurality of vanes.

In Example 26, the hydraulic device of Example 25, wherein the width of the vane step can optionally comprise-substantially 55% of the total width.

In Example 27, the apparatuses and/or systems of any one or any combination of Examples 1-26 can optionally be configured such that all elements or options recited are available to use or select from.

EXPERIMENTAL EXAMPLE

Figure 21:
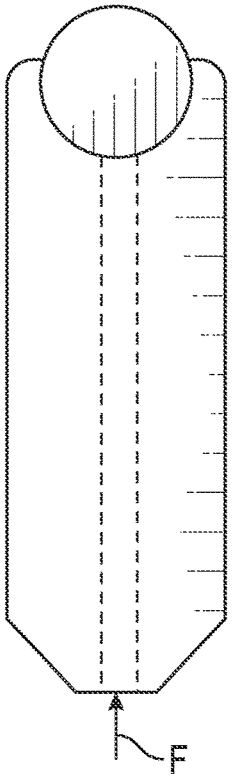
FIGS. 21-25 show various configurations of vanes tested during the experimental example section of the present application.
Figure 22:
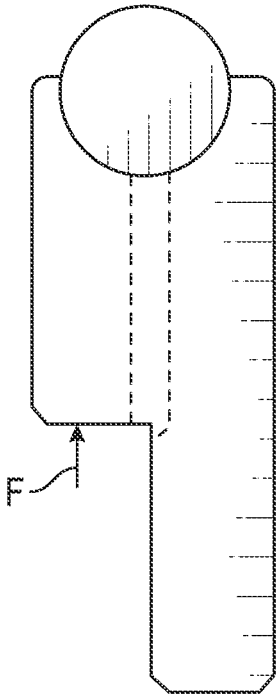
Figure 23:
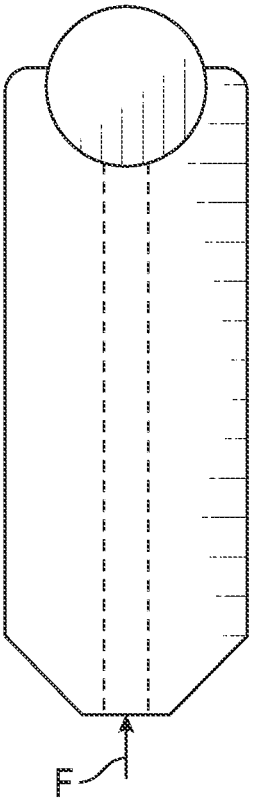
Figure 24:
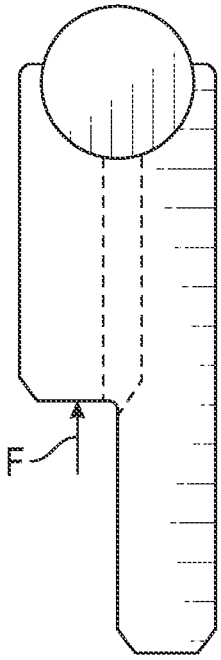
Figure 25:
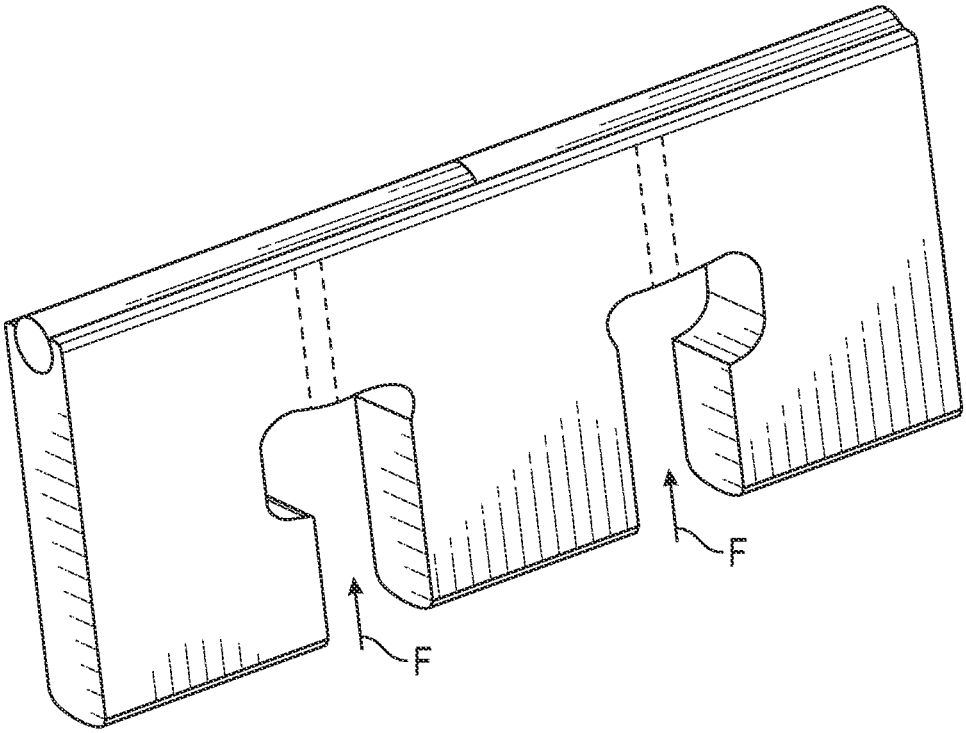

Various configurations of vane were experimentally tested. The configuration of such vanes in cross-section is shown in FIGS. 21-25. A "Type 1" vane is shown in FIG. 21. A "Type 2" vane is shown in FIG. 22. A "Type 3" vane is shown in FIG. 23. A "Type 4" vane is shown in FIG. 24. A "Type 5" vane was shown in FIG. 25. Each vane was provided with a length of 55.66 mm but other dimensions of the vanes were varied according to Type and the dimensions are shown in mm in FIGS. 1-25.

TABLE 1 shown as FIG. 26 tabulates results of the experiment under various conditions. As shown in TABLE 1, only the Type 2 (stepped vane) and the Type 5 were able to pass testing without failing. Testing criteria included testing at various undervane pressures (3000, 3500, and 4500 psi), testing at various motor RPM (2000 and 2500) and were using a maximum ring diameter of 94.7 mm. A needle roller and cages assembly was utilized according to the following specifications:

Type: K90×98×30
Roller number: 44
Basic dynamic load rating: 64.4 KN
Basic static load rating: 173 KN
Fatigue load limit: 21.6 KN
Speed rating: 4500 r/min
Limiting speed: 5300 r/min The claimed invention is:

1. A hydraulic device comprising:
a rotor disposed for rotation about an axis;
a plurality of vanes each including a vane step, each of the plurality of vanes moveable relative to the rotor between a retracted position and an extended position where the plurality of vanes work a hydraulic fluid introduced adjacent the rotor;
a roller mounted to a tip of each of the plurality of vanes; and
a ring disposed at least partially around the rotor, the rotor including one or more passages for ingress or egress of a hydraulic fluid to or from a region adjacent the vane step and defined by at least the rotor and the vane step;
wherein a width of the vane step comprises 55% of a total width of each of the plurality of vanes.

2. The hydraulic device of claim 1, further comprising:
a first thrust bearing disposed adjacent a first axial end of the rotor; and
a second thrust bearing disposed adjacent a second axial end of the rotor, the second axial end opposing the first axial end;
wherein the hydraulic fluid passes across at least one of the first thrust bearing and the second trust bearing to communicate with the one or more passages in the rotor.

3. The hydraulic device of claim 2, further comprising:
a first plate disposed adjacent the first axial end of the rotor and configured to at least partially house the first thrust bearing, the first plate defining at least a first passageway configured to communicate the hydraulic fluid between the ring and the first thrust bearing; and
a second plate disposed adjacent the second axial end of the rotor and configured to at least partially house the second thrust bearing, the second plate defining at least a second passageway configured to communicate the hydraulic fluid to the second thrust bearing.

4. The hydraulic device of claim 3, further comprising at least one poppet valve disposed within one or both of the first plate and the second plate to regulate a flow of the hydraulic fluid.

5. The hydraulic device of claim 3, wherein one or more of the first plate, the second plate and the rotor define an undervane region, the undervane region configured to supply the hydraulic fluid to an inner radial portion of each of the plurality of vanes.

6. The hydraulic device of claim 1, wherein at least one of the plurality of vanes includes a passage extending from the vane step to the tip beneath the roller.

7. The hydraulic device of claim 6, wherein the roller is configured to rotate relative to the vane on a film of the hydraulic fluid.

8. A system comprising:
a hydraulic device, the hydraulic device comprising:
a rotor disposed for rotation about an axis;
a plurality of vanes each including a vane step, each of the plurality of vanes moveable relative to the rotor between a retracted position and an extended position where the plurality of vanes work a hydraulic fluid introduced adjacent the rotor;
a roller mounted to a tip of each of the plurality of vanes;
a ring disposed at least partially around the rotor, the rotor including one or more passages for ingress or egress of a hydraulic fluid to or from a region adjacent the vane step and defined by at least the rotor and the vane step;

an accumulator in fluid communication with the hydraulic device to supply the hydraulic fluid thereto, the hydraulic fluid extending one or more of the plurality of vanes out of the rotor and against the ring such that the hydraulic device is operable as a starter motor;

a first thrust bearing disposed adjacent a first axial end of the rotor;

a second thrust bearing disposed adjacent a second axial end of the rotor, the second axial end opposing the first axial end;

wherein the hydraulic fluid passes across at least one of the first thrust bearing and the second trust bearing to communicate with the one or more passages in the rotor;

a first plate disposed adjacent the first axial end of the rotor and configured to at least partially house the first thrust bearing, the first plate defining at least a first passageway configured to communicate the hydraulic fluid between the ring and the first thrust bearing; and a second plate disposed adjacent the second axial end of the rotor and configured to at least partially house the second thrust bearing, the second plate defining at least a second passageway configured to communicate the hydraulic fluid to the second thrust bearing.

9. The system of claim 8, wherein the hydraulic device further includes at least one poppet valve disposed within one or both of the first plate and the second plate to regulate a flow of the hydraulic fluid.

10. The system of claim 8, wherein one or more of the first plate, the second plate and the rotor define an undervane region, the undervane region configured to supply the hydraulic fluid to an inner radial portion of each of the plurality of vanes.

11. The system of claim 8, wherein at least one of the plurality of vanes includes a passage extending from the vane step to the tip beneath the roller.

12. The system of claim 11, wherein the roller is configured to rotate relative to the vane on a film of the hydraulic fluid.

13. The system of claim 8, wherein a width of the vane step comprises between 45% and 65% of a total width of each of the plurality of vanes.

14. The system of claim 13, wherein the width of the vane step comprises 55% of the total width.

15. A hydraulic device comprising:

a rotor disposed for rotation about an axis;

a plurality of vanes each including a vane step, each of the plurality of vanes moveable relative to the rotor between a retracted position and an extended position where the plurality of vanes work a hydraulic fluid introduced adjacent the rotor;

a roller mounted to a tip of each of the plurality of vanes; and a ring disposed at least partially around the rotor, the rotor including one or more passages for ingress or egress of a hydraulic fluid to or from a region adjacent the vane step and defined by at least the rotor and the vane step;

a first thrust bearing disposed adjacent a first axial end of the rotor;

a second thrust bearing disposed adjacent a second axial end of the rotor, the second axial end opposing the first axial end;

wherein the hydraulic fluid passes across at least one of the first thrust bearing and the second trust bearing to communicate with the one or more passages in the rotor;

a first plate disposed adjacent the first axial end of the rotor and configured to at least partially house the first thrust bearing, the first plate defining at least a first passageway configured to communicate the hydraulic fluid between the ring and the first thrust bearing; and a second plate disposed adjacent the second axial end of the rotor and configured to at least partially house the second thrust bearing, the second plate defining at least a second passageway configured to communicate the hydraulic fluid to the second thrust bearing.

* * * * *